US009057494B1

(12) United States Patent
Liau

(10) Patent No.: US 9,057,494 B1
(45) Date of Patent: Jun. 16, 2015

(54) LIGHT CHARACTER PRODUCER AND ITS EXTENDED APPLICATION IN PHOTOVOLTAICS

(71) Applicant: George Uh-Schu Liau, Markham (CA)

(72) Inventor: George Uh-Schu Liau, Markham (CA)

( * ) Notice: Subject to any disclaimer, the term of this patent is extended or adjusted under 35 U.S.C. 154(b) by 0 days.

(21) Appl. No.: 14/272,800

(22) Filed: May 8, 2014

Related U.S. Application Data

(63) Continuation-in-part of application No. PCT/CA2013/001050, filed on Dec. 16, 2013.

(51) Int. Cl.
*F21V 7/00* (2006.01)
*F21S 9/03* (2006.01)
*F21K 99/00* (2010.01)

(52) U.S. Cl.
CPC .. *F21S 9/037* (2013.01); *F21K 9/54* (2013.01)

(58) Field of Classification Search
CPC .. A41D 27/085; G02B 6/0005; G02B 6/0096; A47B 13/12; A47F 3/001; A47F 11/10
See application file for complete search history.

(56) References Cited

U.S. PATENT DOCUMENTS

2008/0094835 A1* 4/2008 Marra et al. ..... 362/247
2009/0179881 A1* 7/2009 Hibi ..... 345/207
2010/0053952 A1* 3/2010 Levon ..... 362/235
2012/0236586 A1* 9/2012 Wang ..... 362/555

* cited by examiner

*Primary Examiner* — Andrew Coughlin
(74) *Attorney, Agent, or Firm* — Walter J. Tencza, Jr.

(57) ABSTRACT

An apparatus including a first funnel having an inner surface, a transparent solid sphere, a first tube having first and second ends, and a first light emitting diode device having an inner surface with a first light emitting diode. The first end of the first tube may be closer to the transparent solid sphere than the second end of the first tube. The first funnel, the transparent solid sphere, the first tube, and the first light emitting diode device may be configured with respect to each other so that light from the first light emitting diode of the first light emitting diode device is reflected off of the inner surface of the first funnel into the transparent solid sphere, and then from the transparent solid sphere into the first end of the first tube, through the first tube, and out from the second end of the first tube.

6 Claims, 20 Drawing Sheets

LIGHT CHARACTER PRODUCER AND ITS EXTENDED APPLICATION IN PHOTOVOLTAICS

CROSS REFERENCE TO RELATED APPLICATION(S)

The present application is a continuation in part of and claims the priority of PCT patent application serial no. PCT/CA2013/001050 titled "A LIGHT CHARACTER PRODUCER AND ITS EXTENDED APPLICATION IN PHOTOVOLTAICS", filed on Dec. 16, 2013.

FIELD OF THE INVENTION

This invention relates to improved methods and apparatus concerning generating electricity from solar photovoltaic cells.

BACKGROUND OF THE INVENTION

There are various devices known in the prior art for electricity from solar photovoltaic cells and for generating light in general.

SUMMARY OF THE INVENTION

In at least one embodiment, an apparatus is provided comprising a first funnel having an inner surface, a transparent solid sphere, a first tube having a first end and a second end, and a first light emitting diode device having an inner surface with a first light emitting diode.

The first end of the first tube may be closer to the transparent solid sphere than the second end of the first tube. The first funnel, the transparent solid sphere, the first tube, and the first light emitting diode device may be configured with respect to each other so that light from the first light emitting diode of the first light emitting diode device is reflected off of the inner surface of the first funnel into the transparent solid sphere, and then from the transparent solid sphere into the first end of the first tube, then through the first tube, and then out from the second end of the first tube.

In at least one embodiment, the apparatus may be further comprised of second, third, fourth, fifth, and sixth funnels, each substantially the same as the first funnel, and each having an inner surface, and second, third, fourth, fifth, and sixth light emitting diode devices, each having a first light emitting diode.

The first through sixth funnels, the transparent solid sphere, the first tube, and the first through sixth light emitting diode devices are configured with respect to each other so that light from the first light emitting diodes of the first through sixth light emitting diode devices is reflected off of the inner surfaces of the first through sixth funnels into the transparent solid sphere, and then from the transparent solid sphere into the first end of the first tube, then through the first tube, and then out from the second end of the first tube.

The first light emitting diode device may include a second light emitting diode and a third light emitting diode. The first light emitting diode of the first light emitting diode device may emit a red colored light when it is on, the second light emitting diode of the first light emitting diode device may emit a green colored light when it is on, and the third light emitting diode of the first light emitting diode device may emit blue colored light when it is on.

The first funnel, the transparent solid sphere, the first tube, and the first light emitting diode device may be configured with respect to each other so that light from the first through the third light emitting diodes of the first light emitting diode device is reflected off of the inner surface of the first funnel into the transparent solid sphere, and then from the transparent solid sphere into the first end of the first tube, then through the first tube, and then out from the second end of the first tube.

Each of the first through sixth light emitting diode devices may include a second light emitting diode and a third light emitting diode. The first light emitting diode of each of the first through sixth light emitting diode devices may emit a red colored light when it is on, the second light emitting diode of each of the first through sixth light emitting diode device may emit a green colored light when it is on, and the third light emitting diode of each of the first through sixth light emitting diode devices may emit a blue colored light when it is on.

The first through sixth funnels, the transparent solid sphere, the first tube, and the first through sixth light emitting diode devices may be configured with respect to each other so that light from each of the first through the third light emitting diodes of each of the first through sixth light emitting diode devices is reflected off of the inner surface of the first through sixth funnels, respectively, into the transparent solid sphere, and then from the transparent solid sphere into the first end of the first tube, then through the first tube, and then out from the second end of the first tube.

In at least one embodiment of the present application an apparatus is provided which may include a first solid transparent sphere, a first set of bifacial photovoltaic cells, and a first bowl. The first set of bifacial photovoltaic cells may substantially enclose the first solid transparent sphere to form a first unit. The first unit may be mounted to an inner surface of the first bowl. The apparatus may include an enclosed box structure. The first bowl may be mounted to a bottom surface inside of the enclosed box structure.

The apparatus may include a second solid transparent sphere, a second set of bifacial photovoltaic cells, and a second bowl. The second set of bifacial photovoltaic cells may substantially enclose the second solid transparent sphere to form a second unit. The second unit may be mounted to an inner surface of the second bowl. The second bowl may be mounted to the bottom surface inside of the enclosed box structure, separated by a distance from the first bowl.

In at least one embodiment a method is provided which includes the steps of sensing a colored light from an apparatus, and assigning a code to the colored light based on the color of the colored light. The colored light may be generated by an apparatus; wherein the apparatus includes a first funnel having an inner surface; a transparent solid sphere; a first tube having a first end and a second end; and a first light emitting diode device having an inner surface with first, second, and third light emitting diodes. The first light emitting diode may emit a red color light when on, wherein the second light emitting diode may emit a green color light when on, and wherein the third light emitting diode may emit a blue color light when on. The first end of the first tube may be closer to the transparent solid sphere than the second end of the first tube. The first funnel, the transparent solid sphere, the first tube, and the first light emitting diode device may be configured with respect to each other so that light from the first, second, and third light emitting diodes of the first light emitting diode device is reflected off of the inner surface of the first funnel into the transparent solid sphere, and then from the transparent solid sphere into the first end of the first tube, then through the first tube, and then out from the second end of the first tube; and the light from the first, second, and third light emitting diodes may be mixed together in the transparent solid sphere to form the colored light.

DETAILED DESCRIPTION OF THE DRAWINGS

Figure 1A:
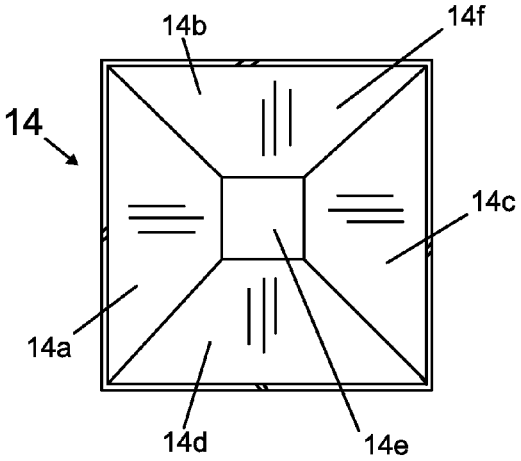
FIG. 1A shows a top view of a funnel for use with an embodiment of the present invention.
Figure 1B:
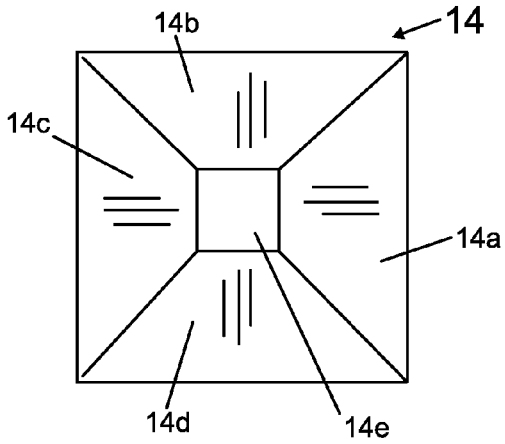
FIG. 1B shows a bottom view of the funnel of FIG. 1A.
Figure 1C:
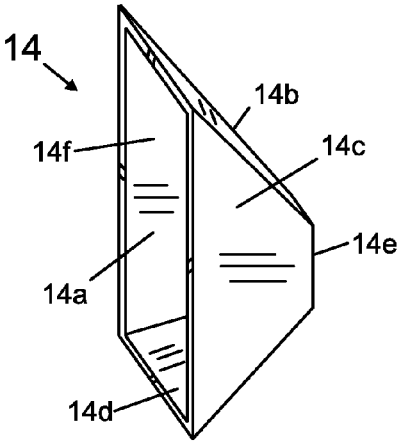
FIG. 1C shows a top, right side, rear perspective view of the funnel of FIG. 1A.
Figure 1D:
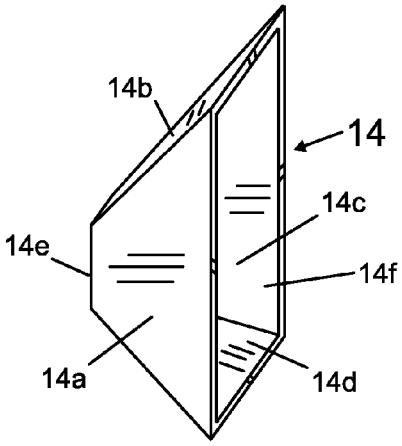
FIG. 1D shows a top, left side, and rear perspective view of the funnel of FIG. 1A.
Figure 1E:
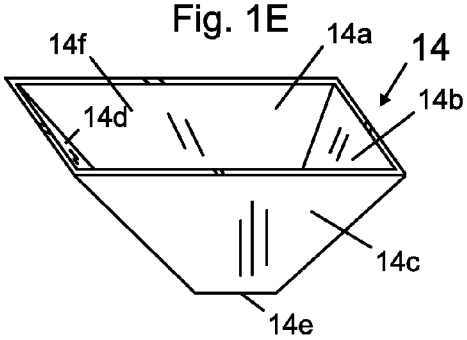
FIG. 1E shows a top and right side perspective view of the funnel of FIG. 1A.
Figure 1F:
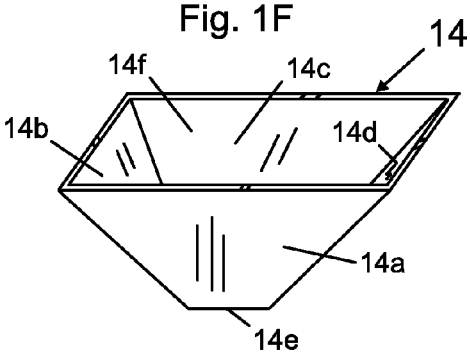
FIG. 1F shows a top and left side perspective view of the funnel of FIG. 1A.
Figure 1G:
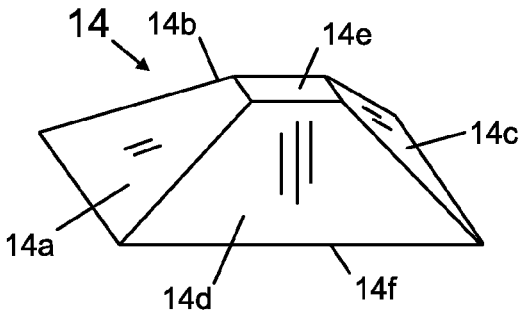
FIG. 1G shows a bottom, left side, and front perspective view of the funnel of FIG. 1A.
Figure 1H:
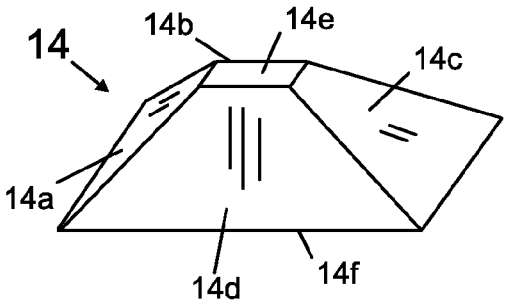
FIG. 1H shows a bottom, right side, and front perspective view of the funnel of FIG. 1A.
Figure 1I:
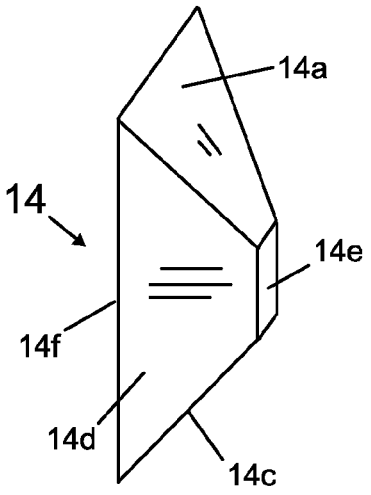
FIG. 1L shows a bottom, front, and left side perspective view of the funnel of FIG. 1A.
FIG. 1J shows a bottom, rear, and left side perspective view of the funnel of FIG. 1A.
Figure 1J:
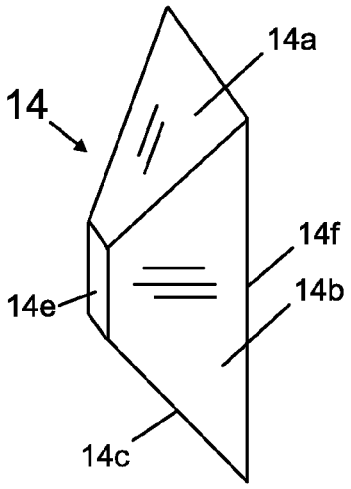
Figure 10:
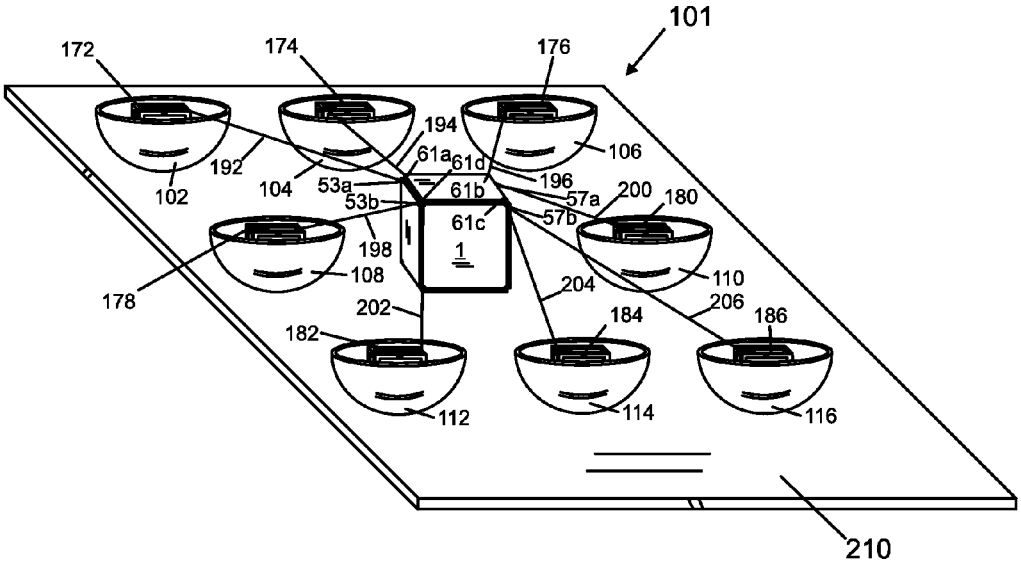
FIG. 10 shows a perspective view of a eight fifth combinations and the third combination of FIG. 3B fixed to a plate, and with a plurality of tubes connecting the third combination of FIG. 3B with each of the eight fifth combinations.

FIG. 1A shows a top view of a funnel 14 for use with an embodiment of the present invention. FIG. 1B shows a bottom view of the funnel 14. FIG. 10 shows a top, right side, rear perspective view of the funnel 14. FIG. 1D shows a top, left side, and rear perspective view of the funnel 14. FIG. 1E shows a top and right side perspective view of the funnel 14. FIG. 1F shows a top and left side perspective view of the funnel 14. FIG. 1G shows a bottom, left side, and front perspective view of the funnel 14. FIG. 1H shows a bottom, right side, and front perspective view of the funnel 14. FIG. 1L shows a bottom, front, and left side perspective view of the funnel 14. FIG. 1J shows a bottom, rear, and left side perspective view of the funnel 14.

The funnel 14, in at least one embodiment is made of metal, such as an aluminum alloy. The funnel 14 includes sides 14*a*, 14*b*, 14*c*, and 14*d*. The funnel 14 has a top large square opening 14*f* and a bottom smaller square opening 14*e*. The inside surfaces of the sides or panels 14*a-d* as shown in FIG.

1A may be used as reflector panels to reflect light, and thus may be made of a material which reflects light.

Figure 2A:
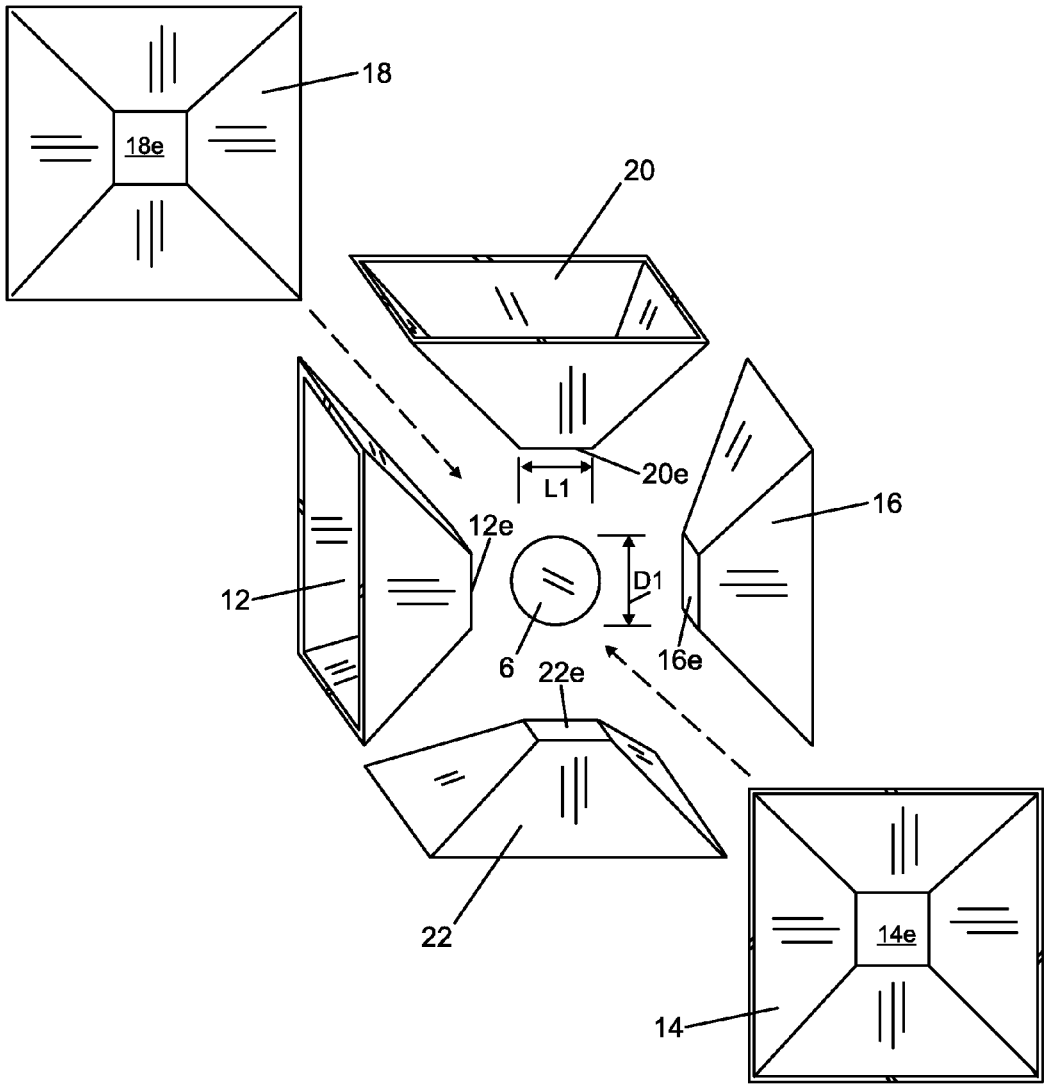
FIG. 2A shows a perspective view of six funnels and a ball, taken apart, for use with an embodiment of the present invention.
Figure 2B:
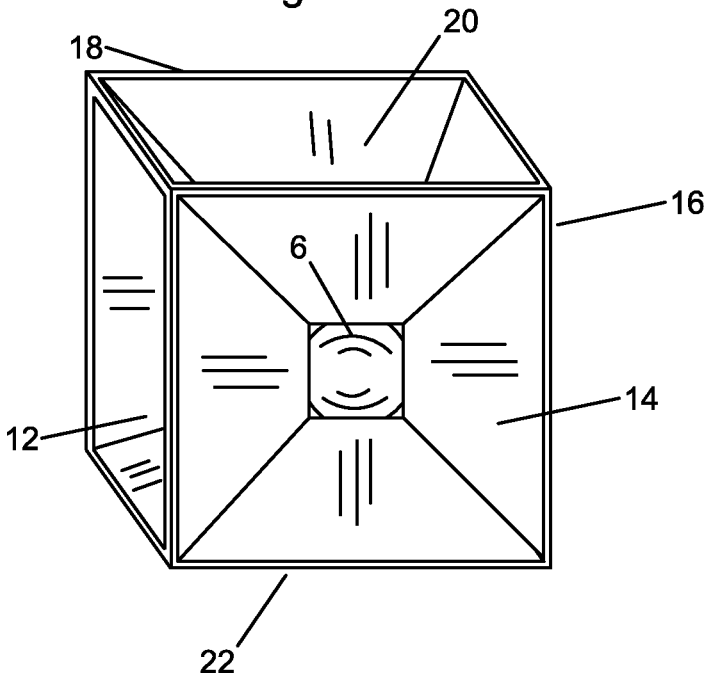
FIG. 2B shows a perspective view of the six funnels and the ball of FIG. 2A assembled together to form a first combination.

FIG. 2A shows a perspective view of six funnels, 12, 14, 16, 18, 20, and 22, and a solid sphere or ball 6, for use with an embodiment of the present invention. Each of the funnels 12, 16, 18, 20, and 22 is identical to the funnel 14 described with reference to FIGS. 1A-1J. The funnels 12, 14, 16, 18, 20, and 22 have bottom square openings 12*e*, 14*e*, 16*e*, 18*e*, 20*e*, and 22*e*, respectively as shown in FIG. 2A. Each of the bottom square openings 1*e*, 14*e*, 16*e*, 18*e*, 20*e*, and 22*e* has a side having a length of L1 as shown for opening 20*e* in FIG. 2A. The ball 6 has a diameter of D1 as shown in FIG. 2A. In at least one embodiment, the diameter D1 of the ball 6 is larger than the length L1 of each of the bottom square openings 12*e*, 14*e*, 16*e*, 18*e*, 20*e*, and 22*e*. This allows the funnels 12, 14, 16, 18, 20, and 22 to hold the solid sphere or ball 6 in place when the funnels 12-22 are connected as in FIG. 2B, i.e. the ball 6 does not fall through any of the openings 12*e*-22*e*. In addition in at least one embodiment, when the funnels 12, 14, 16, 18, 20, and 22 are connected as in FIG. 2B, the six bottom square openings form a cube shape with side length L1. In at least one embodiment, the diameter of the ball 6 is approximately equal to the (square root of two) times the length of a side L1 of each of the square openings 12*e*-22*e*. These dimensions in at least one embodiment are critical allowing the funnels 12, 14, 16, 18, 20, and 22 to be attached, fit, or glued together tightly together in the form of FIG. 2B, while the ball 6 tightly in between so that the ball 6 does not move. In at least one embodiment, the dimensions L1 and D1 are determined from a square of length L1 inscribing a circle of diameter D1. FIG. 2B shows a perspective view of the six funnels 12, 14, 16, 18, 20, and 22 and the ball 6 of FIG. 2A assembled together to form a first combination, which is shown from a front, top, and left perspective view.

Figure 2C:
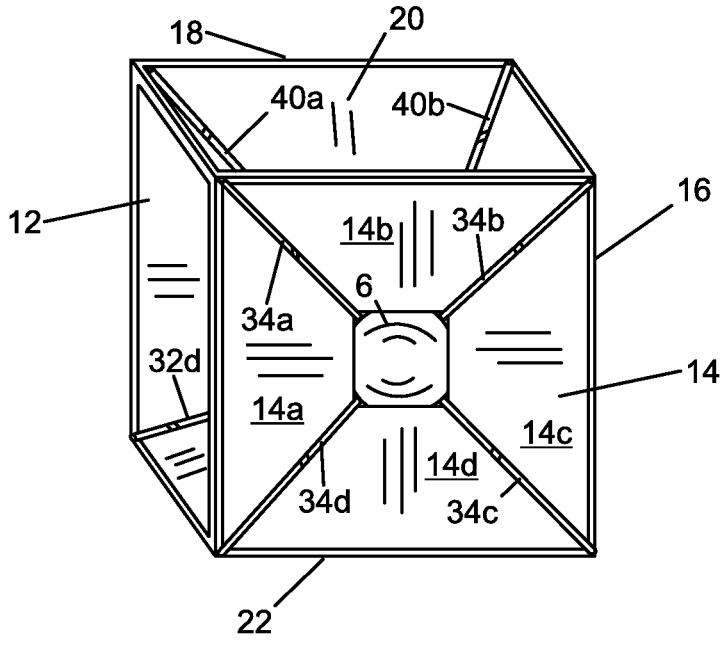
FIG. 2C shows a perspective view of a plurality of tubes attached to the first combination of FIG. 2B to form a second combination.

FIG. 2C shows a front, top, and left perspective view of tubes 34*a*, 34*b*, 34*c*, 34*d*, 32*d*, 40*a*, and 40*b* attached to the first combination of FIG. 2B, as part of forming a second combination. In the funnel 14, the tube 34*a* is attached to the junction of sides 14*a* and 14*b*, the tube 34*b* is attached to the junction of sides 14*b* and 14*c*, the tube 34*c* is attached to the junction of sides 14*c* and 14*d*, and the tube 34*d* is attached to the junction of sides 14*d* and 14*a*. Each of tubes 34*a*-*d* is hollow and allows for the transmission of light through a bore or central opening through each of the hollow tubes 34*a*-*d*. Each of the tubes 34*a*-*d* has a first end which is adjacent the ball 6, so that light coming out of the ball 6 at the location where the particular tube of 34*a*-*d* is located, will go into the particular tube of tubes 34*a*-*d*. Each of the tubes 34*a*-*d* has a second end which is opposite the first end, and which is located near a corner of the overall second combination of FIG. 2C. Light from the ball 6, near the first end of the particular tube, passes into the tube at the first end, through the tube, and then out the second end of the particular tube of the tubes 34*a*-*d*.

Each of the funnels 12, 16, 18, 20, and 22 has four tubes attached to them, analogous to tubes 34*a*-*d*, in an identical manner to funnel 14. However, only tubes 32*d*, 40*a* and 40*b* can be seen in the perspective view of FIG. 2C.

Figure 3A:
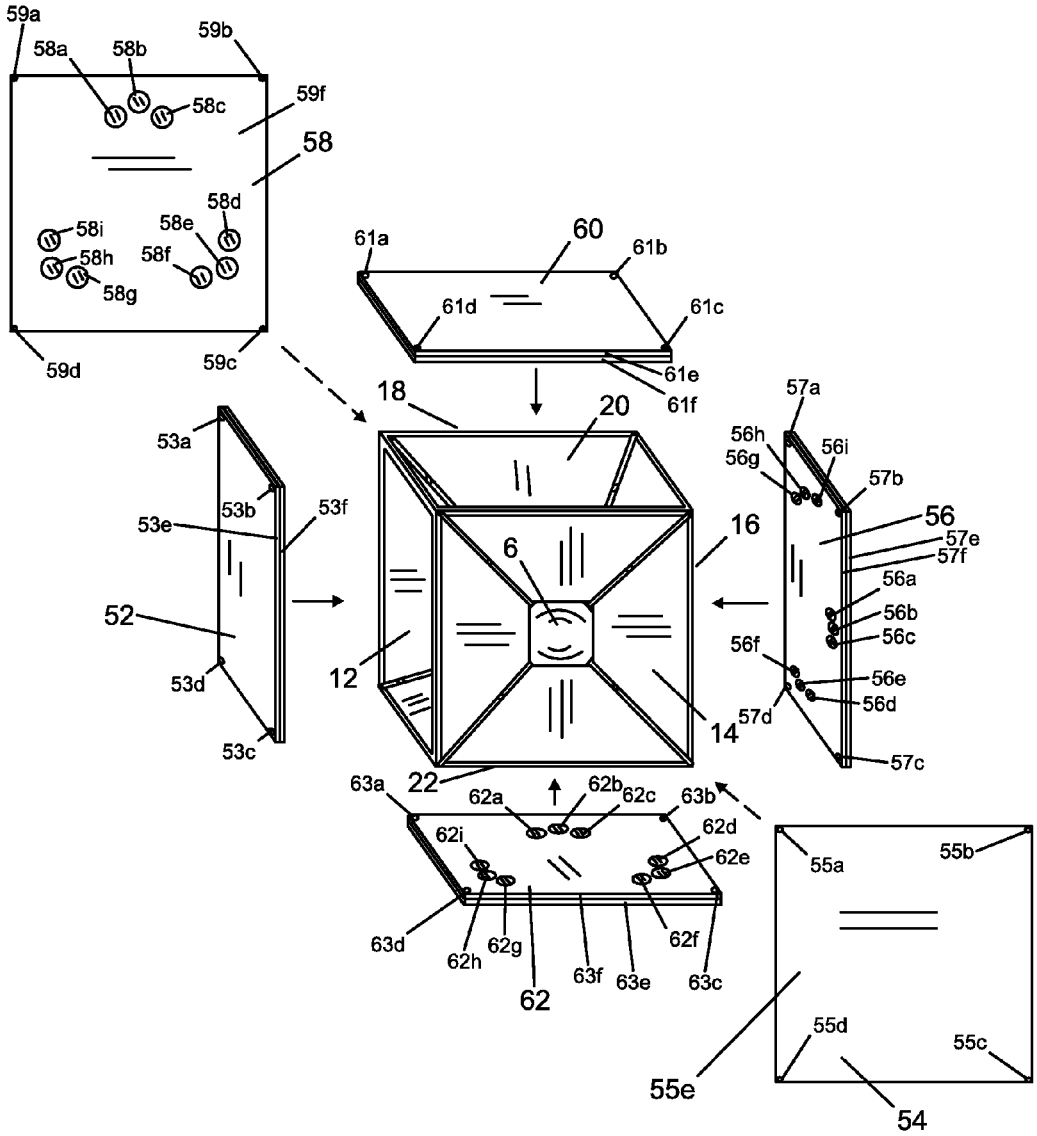
FIG. 3A shows a perspective view of a plurality of light emitting diode devices separated from the second combination of FIG. 2C.

FIG. 3A shows a perspective view of a light emitting diode devices 52, 54, 56, 58, 60, and 62 separated from the second combination of FIG. 2C. Each of light emitting diode devices 52, 54, 56, 58, 60, and 62 may be identical to each other. The light emitting diode device 52 includes a cover plate 53*e*, typically made of plastic, and a circuit board or plate 53*f* typically made of plastic. There are openings 53*a*, 53*b*, 53*c*, and 53*d*, at the corners which go through both the cover plate 53*e* and the board or plate 53*f*. There are light emitting diodes on the inside of the board or plate 53*f*, which are not shown in FIG. 3A, but what may be identical and/or analogous to light emitting diodes 58*a*-58*i* and arranged in a similar or identical manner to light emitting diodes 58*a*-58*i*.

Similarly, analogously, or identically, the light emitting diode device 54 may include includes a cover plate 55*e* made of plastic, and a circuit board or plate not shown made of plastic, identical or analogous to plate 53*e* and 53*f*. There are openings 55*a*, 55*b*, 55*c*, and 55*d*, at the corners which go through both the cover plate 55*e* and the board or plate, corresponding to 53*f*, but for device 54. There are light emitting diodes on the inside of the board or plate, corresponding to 53*f*, which are not shown in FIG. 3A, but what may be identical and/or analogous to light emitting diodes 58*a*-58*i* and arranged in a similar or identical manner to light emitting diodes 58*a*-58*i*.

Similarly, analogously, or identically, the light emitting diode device 56 may include includes a cover plate 57*e* made of plastic, and a circuit board or plate 57*f* made of plastic, identical or analogous to plate 53*e* and 53*f*. There are openings 57*a*, 57*b*, 57*c*, and 57*d*, at the corners which go through both the cover plate 57*e* and the board or plate 57*f*. There are light emitting diodes 56*a*, 56*b*, 56*c*, 56*d*, 56*e*, 56*f*, 56*g*, 56*h*, and 56*i* on the inside of the board or plate 57*f*, that may be identical and/or analogous to light emitting diodes 58*a*-58*i* and arranged in a similar or identical manner to light emitting diodes 58*a*-58*i*.

Similarly, analogously, or identically, the light emitting diode device 58 may include includes a cover plate, not shown analogous to plate 57*e* made of plastic, and a circuit board or plate 59*f* made of plastic, identical or analogous to plate 53*e* and 53*f*. There are openings 59*a*, 59*b*, 59*c*, and 59*d*, at the corners which go through both the cover plate, not shown analogous to plate 57*e* and the board or plate 59*f*. There are light emitting diodes 58*a*, 58*b*, 58*c*, 58*d*, 58*e*, 58*f*, 58*g*, 58*h*, and 58*i* on the inside of the board or plate 59*f*.

Similarly, analogously, or identically, the light emitting diode device 60 may include includes a cover plate 60*e* made of plastic, and a circuit board or plate 60*f* made of plastic, identical or analogous to plate 53*e* and 53*f*. There are openings 61*a*, 61*b*, 61*c*, and 61*d*, at the corners which go through both the cover plate 61*e* and the board or plate 61*f*. There are light emitting diodes, not shown, analogous to diodes 58*a*-58*i* on the inside of the board or plate 61*f*, that may be identical and/or analogous to light emitting diodes 58*a*-58*i* and arranged in a similar or identical manner to light emitting diodes 58*a*-58*i*.

Similarly, analogously, or identically, the light emitting diode device 62 may include includes a cover plate 63*e* made of plastic, and a circuit board or plate 63*f* made of plastic, identical or analogous to plate 53*e* and 53*f*. There are openings 63*a*, 63*b*, 63*c*, and 63*d*, at the corners which go through both the cover plate 63*e* and the board or plate 63*f*. There are light emitting diodes 62*a*, 62*b*, 62*c*, 62*d*, 62*e*, 62*f*, 62*g*, 62*h*, and 62*i*, on the inside of the board or plate 63*f*, that may be identical and/or analogous to light emitting diodes 58*a*-58*i* and arranged in a similar or identical manner to light emitting diodes 58*a*-58*i*.

Figure 3B:
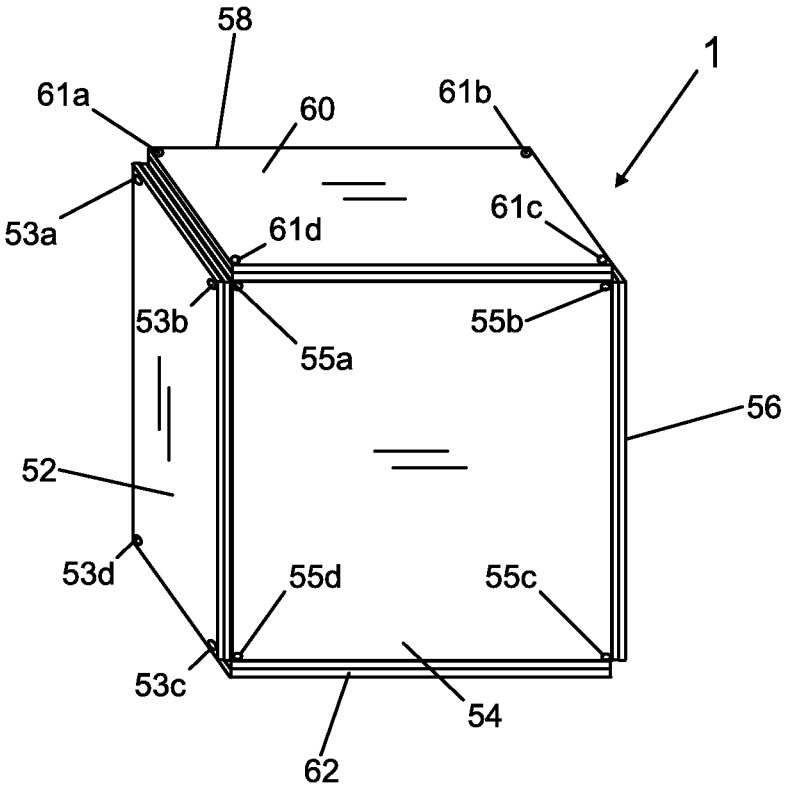
FIG. 3B shows a perspective view of the plurality of light emitting diode devices connected to the second combination of FIG. 2C to form a third combination.

FIG. 3B shows a perspective view of the plurality of light emitting diode devices 52, 54, 56, 58, 60, and 62 connected to the second combination of FIG. 2C to form a third combination which may be referred to as apparatus or cube 1.

Figure 17:
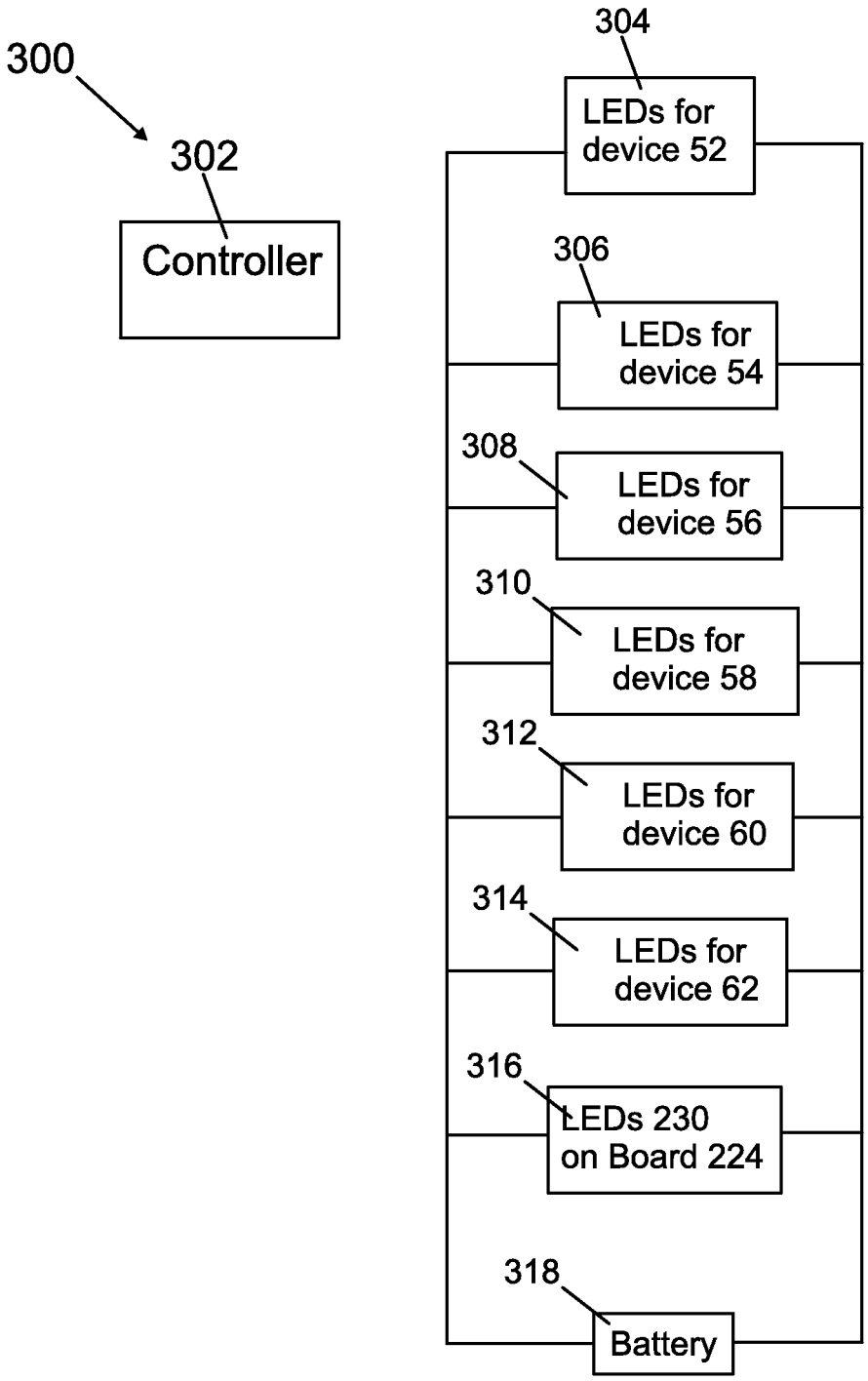
FIG. 17 shows a block diagram of a method and/or apparatus in accordance with an embodiment of the present invention.

FIG. 17 is a simplified block diagram 300 for describing a method and/or apparatus in accordance with an embodiment of the present invention. Blocks 304, 306, 308, 310, 312, and 314, represent light emitting diodes (LEDs) for device 52 (not shown in FIG. 3A but analogous to 58*a*-*i*), for device 54 (not shown in FIG. 3A but analogous to 58*a-i*), for device 56 (56*a-i*), for device 58 (58*a-i*), for device 60 (not shown in FIG. 3A but analogous to 58*a-i*), and for device 62 (62*a-i*), respectively. Block 316 represents LEDs 230 on board 224 shown in FIG. 15A.

The diagram 300 also shows controller 302 which may include a remote control device and/or a control device electrically connected, such as wirelessly or by hardwiring, to the LEDs of blocks 304-316. The diagram 300 also shows a battery 318. Each of the LEDs of blocks 304-316 may be switched on so that they are active, powered on, and electrically connected to the battery 318 by the Controller 302. The controller 302 may remotely control a switch which may be included as part of each LED of LEDs of blocks 304-314. The controller 302 may also include a transmitter for sending a transmit signal wirelessly. Each of the LEDs of blocks 304-316 may include a receiver for receiving a wireless signal and for using the wireless signal to turn on or turn off any of the LEDs of blocks 304-316. The controller 302 may also include a computer processor, a power source, a computer memory, a computer interactive device, such as a computer mouse, touchscreen, or keyboard, and a computer display.

Thus in operation, any of the LEDs of blocks 304-316 may be individually controlled, i.e. turned on or off to cause light to come out of one or more of the openings 53*a-d*, 55*a-d*, 57*a-d*, 59*a-d*, 61*a-d*, and 63*a-d* of the assembled apparatus 1 in FIG. 3B (note that all openings of apparatus 1 are shown in FIG. 3A), and/or light from LEDs 230 on board 224. One or more of fifty-four LEDs (nine LEDs for each of six LED devices 52, 54, 56, 58, 60, and 62) can be controlled to cause light to come out of one or more of twenty-four tubes (four tubes for each of six funnels 12, 14, 16, 18, 20, and 22). However, in at least one embodiment, as shown in FIG. 10 only eight openings 61*a-d*, 53*a-b*, and 57*a-b* are used and the other openings 53*c-d*, 57*c-d*, 55*a-d*, 59*a-d*, and 63*a-d* are closed.

For the light character producer or apparatus 1, one or more tubes, of tubes may be used to transmit the mixed light in accordance with the numeric order. Tubes not used should be closed at openings on covers.

Figure 4A:
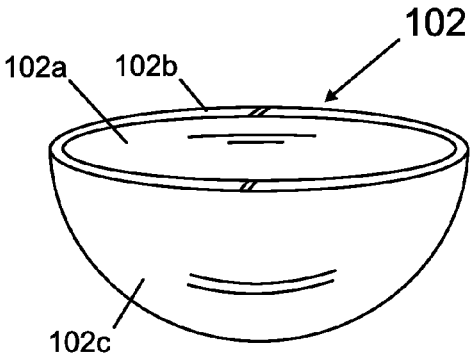
FIG. 4A shows a top and front perspective view of a bowl.
Figure 4B:
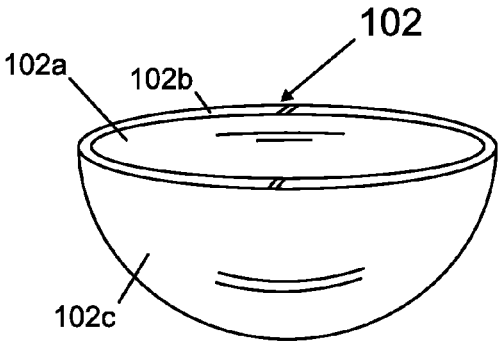
FIG. 4B shows a top and rear perspective view of the bowl of FIG. 4A.
Figure 4C:
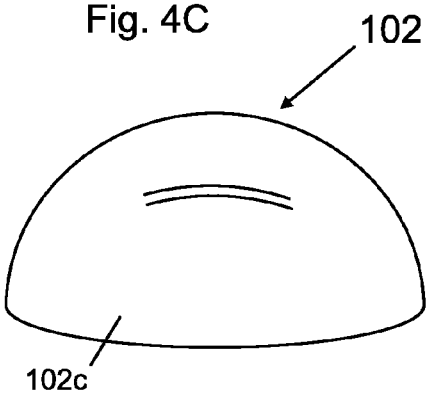
FIG. 4C shows a bottom and front perspective view of the bowl of FIG. 4A.
Figure 4D:
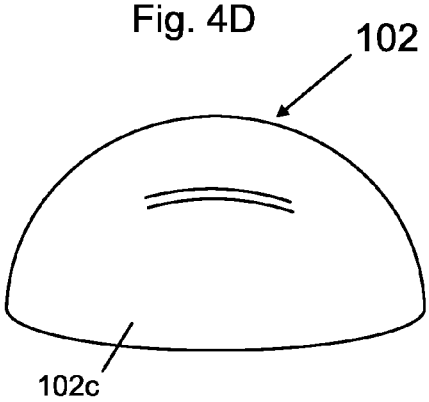
FIG. 4D shows a bottom and rear perspective view of the bowl of FIG. 4A.

FIG. 4A shows a top and front perspective view of a bowl 102. FIG. 4B shows a top and rear perspective view of the bowl 102. FIG. 4C shows a bottom and front perspective view of the bowl 102. FIG. 4D shows a bottom and rear perspective view of the bowl 102. The bowl 102 has an inner surface 102*a*, a rim 102*b*, and an outer surface 102*c*. The bowl 102 may be made of metal, such as aluminum alloy.

Figure 5A:
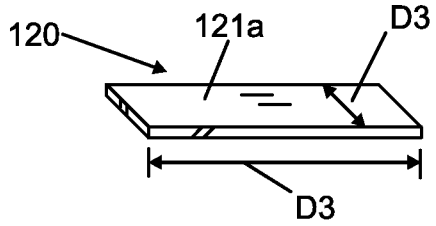
FIG. 5A shows a top, front, and left perspective view of a plate.
Figure 5B:
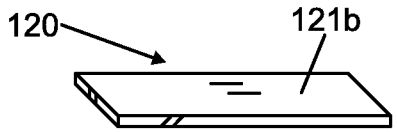
FIG. 5B shows a bottom, rear, and right perspective view of the plate of FIG. 5A.

FIG. 5A shows a top, front, and left perspective view of a plate 120. FIG. 5B shows a bottom, rear, and right perspective view of the plate 120. The plate 120 may be square, and may have a length and a width, each of which is equal to D3. The plate 120 may be a solar photovoltaic bifacial cell as known in the art, which is used to generate electricity on both sides/faces 121*a* shown in FIG. 5A and 121*b* shown in FIG. 5B of the plate 120 by photovoltaic effect.

Figure 6A:
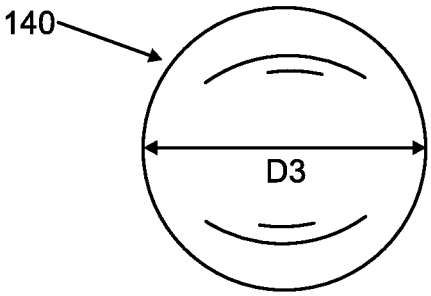
FIG. 6A shows a front perspective view of a ball.
Figure 6B:
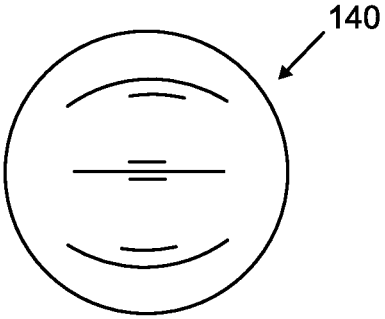
FIG. 6B shows a rear perspective view of the ball of FIG. 6A.

FIG. 6A shows a front perspective view of a ball 140. FIG. 6B shows a rear perspective view of the ball 140. The ball 140 may have a diameter D3 which may be the same as the length and the width of the plate 120.

Figure 7A:
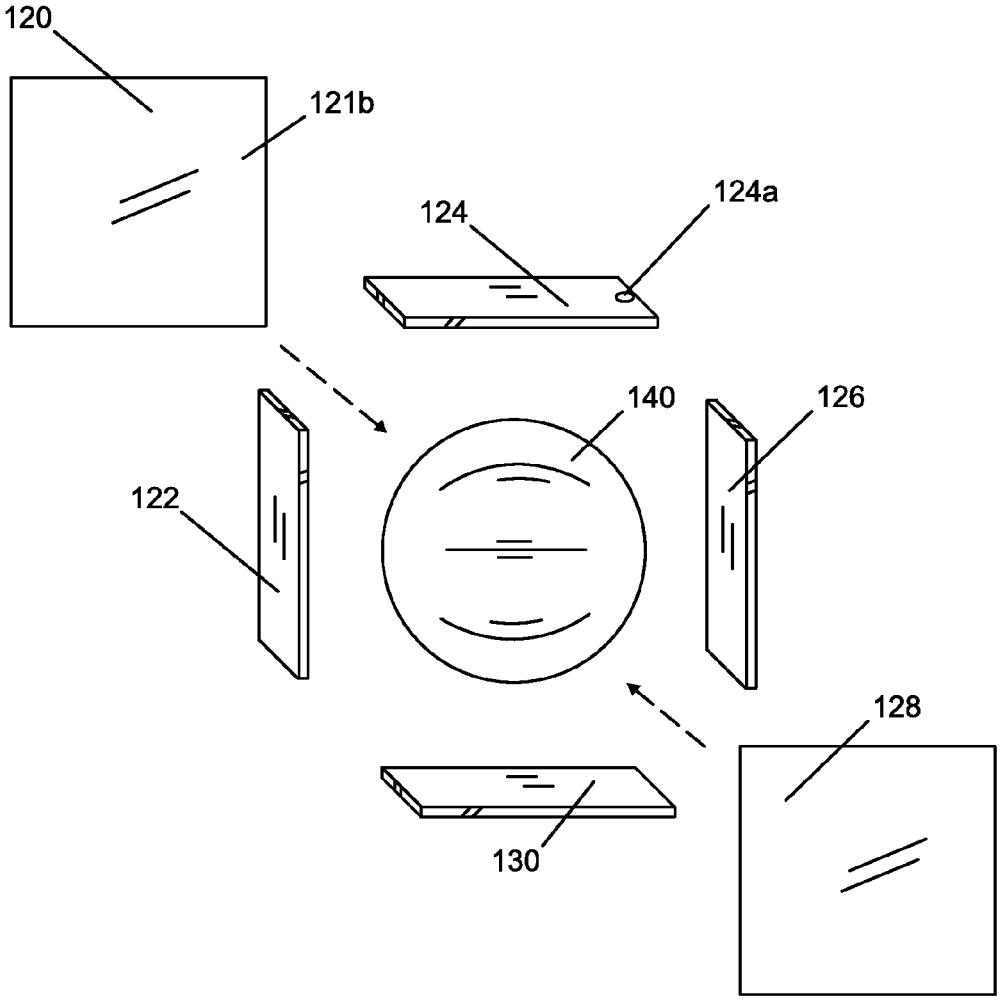
FIG. 7A shows a perspective view of the ball of FIG. 6A and six plates, with the six plates not connected to the ball of FIG. 6A.

FIG. 7A shows a perspective view of the ball 140 and six plates, 120, 122, 124, 126, 128, and 130, with the six plates 120-130 not connected to the ball 140. Each of the six plates 120-130 may be identical to the plate 120 shown in FIGS. 5A-B, except that plate 124 may have an opening 124*a* through the plate 124.

Figure 7B:
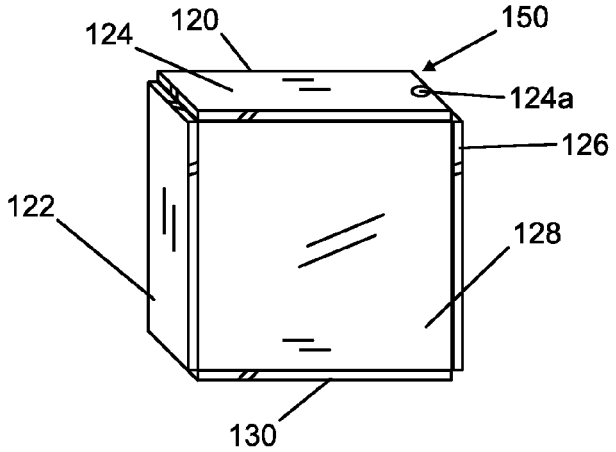
FIG. 7B shows a perspective view of the six plates connected to the ball of FIG. 6A, with the ball enclosed inside combination of the six plates.

FIG. 7B shows a perspective view of the six plates, 120, 122, 124, 126, 128, and 130 connected to the ball 140, with the ball enclosed inside the combination of the six plates 120-130 to form an apparatus or cube 150. Light can get into the ball 140 inside of the apparatus or cube 150 only through the single opening 124*a* in the combination of FIG. 7B.

Figure 8:
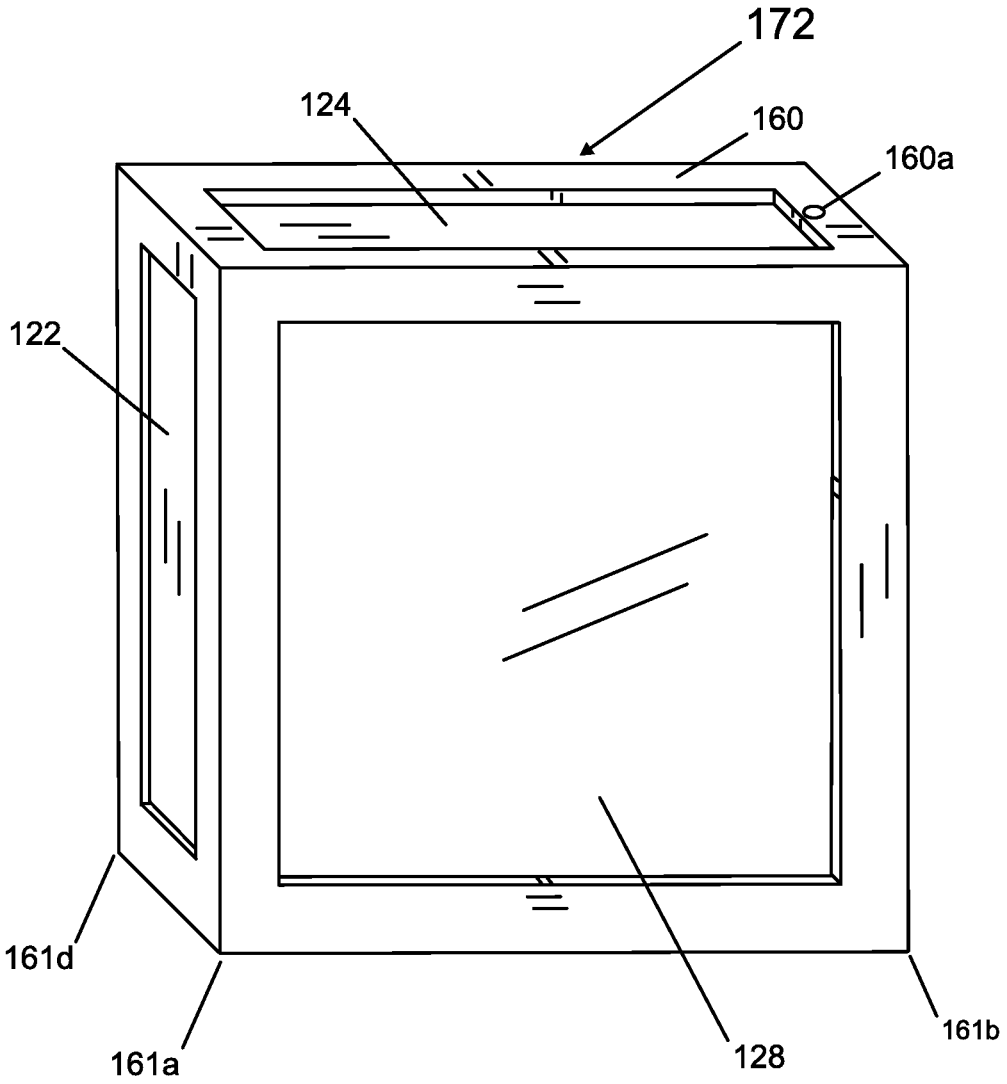
FIG. 8 shows a perspective view of a frame structure which holds the six plates of FIGS. 7A-7B together to form a fourth combination.

FIG. 8 shows a perspective view of a frame structure 160 holding the apparatus or cube 150 of FIG. 7B, including the six plates 120-130, together, with the ball 140 inside of the enclosure provided by the six plates 120-130 to form a fourth combination or apparatus 172. The frame structure 160 is made of plastic.

Figure 9A:
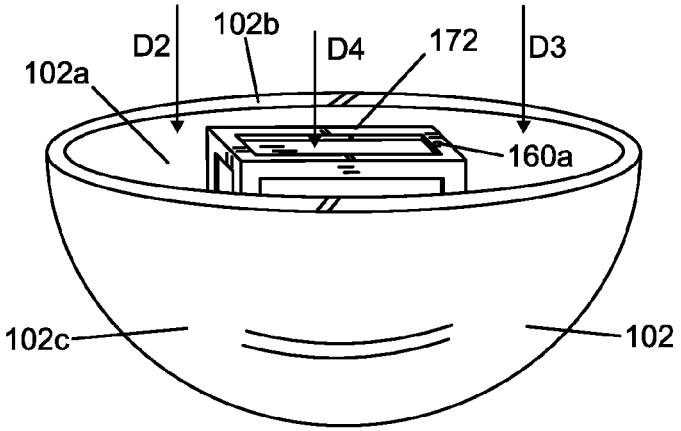
FIG. 9A shows a perspective view of the fourth combination of FIG. 8 attached to the inside of the bowl of FIGS. 4A-4D to form a fifth combination.
Figure 9B:
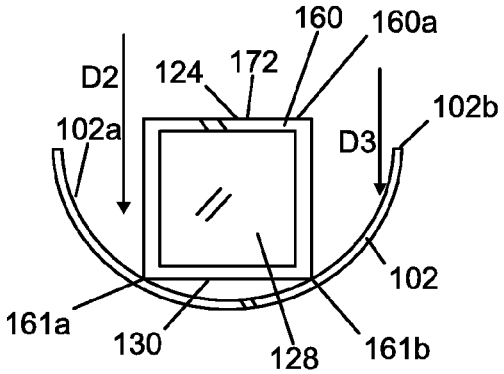
FIG. 9B shows a front sectional view of the fifth combination of FIG. 9A.

FIG. 9A shows a perspective view of the fourth combination or apparatus 172 of FIG. 8 attached to the inside surface 102*a* of the bowl 102 of FIGS. 4A-4D to form a fifth combination. Note that the fourth combination or apparatus 172 of FIG. 8 should be attached to the inner surface 102*a* of the bowl 102 so that the entrance to the opening 160*a* is above the rim 102*b* of the bowl 102 as shown by FIG. 9B. This is done so that the bowl 102 does not prevent or substantially inhibit light from coming into opening 160*a*, and thus into opening 124*a* which is aligned with opening 160*a*, and into the ball 140.

Figure 9C:
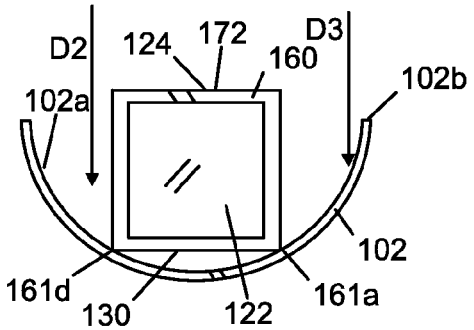
FIG. 9C shows a left sectional view of the fifth combination of FIG. 9A.
Figure 9D:
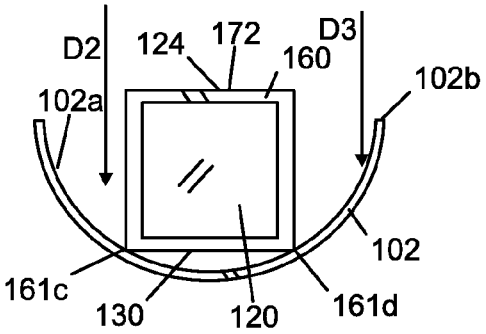
FIG. 9D shows a rear sectional view of the fifth combination of FIG. 9A.
Figure 9E:
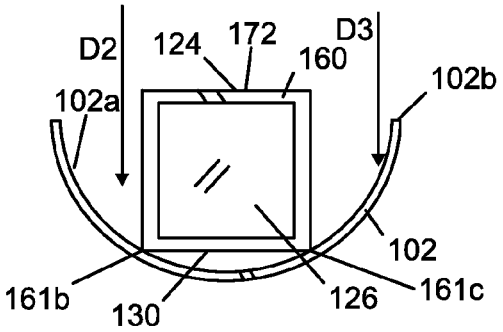
FIG. 9E shows a right sectional view of the fifth combination of FIG. 9A.

FIG. 9B shows a front sectional view of the fifth combination of FIG. 9A. FIG. 9C shows a left sectional view of the fifth combination of FIG. 9A. FIG. 9D shows a rear sectional view of the fifth combination of FIG. 9A. FIG. 9E shows a right sectional view of the fifth combination of FIG. 9A.

As shown by FIGS. 9A-9E, light comes into the bowl 102 in the directions D2 and D3. The light reflects off the inside surface 102*a* of the bowl 102 and thereby into plates 120, 122, 126, 128, and 130. Light from above plate 124 in the direction D4 shown in FIG. 9A, impacts on the outer surface solar cell of the plate 124. The apparatus or combination 172 is mounted to the inside surface 102*a* of the bowl 102 so that only four corners 161*a*, 161*b*, 161*c*, and 161*d*, shown by the combination of FIGS. 8, and 9B-9E, touch the inside surface 102*a* and are mounted on the inside surface 102*a* of the bowl 102. This mounting arrangement allows light to go underneath the apparatus 172 and impact on a solar cell of the outer surface of the bottom plate 130. Thus the bowl 102 and the mounting arrangement of the apparatus 172 to the bowl 102, causes light to impact on outer surface solar cells of plates 120, 122, 126, 128, and 130, while the outer surface solar cell of plate 124 is impacted by light from above in the direction D4.

FIG. 10 shows a perspective view of an apparatus 101 including eight fifth combinations of FIG. 9 and the apparatus, or cube 1 of FIG. 3B fixed to a plate 210, and with a plurality of tubes 192, 194, 196, 198, 200, 202, 204, and 206 connecting the apparatus, or cube 1 of FIG. 3B with the eight fifth combinations.

The apparatus 101 of FIG. 10 includes bowls 102, 104, 106, 108, 110, 112, 114, and 116. Each of bowls 102-116 may be identical and may be the same as bowl 102 which was previously described with reference to FIGS. 4A-4D. The apparatus 101 further includes apparatus or devices 172, 174, 176, 178, 180, 182, 184, and 186, each of which may be identical to apparatus or device previously described with reference to FIG. 8. Each of the apparatuses or devices 172-186 is attached to its respective bowl of 102-116 in the same manner as previously described with reference to FIG. 9.

As shown in FIG. 10, the opening 61*a* in apparatus or cube 1 is connected to a first end of tube 194. A second end of tube 194, which opposes the first end of tube 194, is connected to an opening of apparatus or device 174, similar, identical or analogous to opening 160*a* of the apparatus or device 172. Light leaving the apparatus or cube 1, through the opening 61*a* goes into the first end of tube 194, travels through the tube 194, and into the opening of apparatus or device 174, analogous to opening 160*a* of the device 172. Ultraviolet light gets into the photovoltaic cube or apparatus 172 in FIG. 8 through openings 160*a* and 124*a* to cause photovoltaic effect on the six inner faces such as face 121*b* of plate 120 shown in FIG. 7A, and analogous inner faces of plates 122, 124, 126, 128, and 130 which face the ball 140 shown in FIG. 7A. In at least one embodiment, light comes in openings 160*a* and 124*a* and no light gets out from inside the enclosure bounded by 120, 122, 124, 126, 128, and 130 through the plates 120, 122, 124, 126, 128, and 130 or through the openings 160*a* and 124*a*.

The opening 61*b* in apparatus or cube 1 is connected to a first end of tube 196. A second end of tube 196, which opposes the first end of tube 196, is connected to an opening of apparatus or device 176, similar, identical or analogous to opening 160*a* of the apparatus or device 172. Light leaving the apparatus or cube 1, through the opening 61*b* goes into the first end of tube 196, travels through the tube 196, and into the opening of apparatus or device 176, analogous to opening 160*a* of the device 172.

The opening 61*c* in apparatus or cube 1 is connected to a first end of tube 204. A second end of tube 204, which opposes the first end of tube 204, is connected to an opening of apparatus or device 184, similar, identical or analogous to opening 160*a* of the apparatus or device 172. Light leaving the apparatus or cube 1, through the opening 61*c* goes into the first end of tube 204, travels through the tube 204, and into the opening of apparatus or device 184, analogous to opening 160*a* of the device 172.

The opening 61*d* in apparatus or cube 1 is connected to a first end of tube 198. A second end of tube 198, which opposes the first end of tube 198, is connected to an opening of apparatus or device 178, similar, identical or analogous to opening 160*a* of the apparatus or device 172. Light leaving the apparatus or cube 1, through the opening 61*d* goes into the first end of tube 198, travels through the tube 198, and into the opening of apparatus or device 178, analogous to opening 160*a* of the device 172.

The opening 53*a* in apparatus or cube 1 is connected to a first end of tube 192. A second end of tube 192, which opposes the first end of tube 192, is connected to the opening 160*a* of apparatus or device 172. Light leaving the apparatus or cube 1, through the opening 53*a* goes into the first end of tube 192, travels through the tube 192, and into the opening 160*a* of apparatus or device 172.

The opening 53*b* in apparatus or cube 1 is connected to a first end of tube 202. A second end of tube 202, which opposes the first end of tube 202, is connected to an opening of apparatus or device 182, similar, identical or analogous to opening 160*a* of the apparatus or device 172. Light leaving the apparatus or cube 1, through the opening 53*b* goes into the first end of tube 202, travels through the tube 202, and into the opening of apparatus or device 182, similar, identical to or analogous to opening 160*a* of the device 172.

The opening 57*a* in apparatus or cube 1 is connected to a first end of tube 200. A second end of tube 200, which opposes the first end of tube 200, is connected to an opening of apparatus or device 180, similar, identical or analogous to opening 160*a* of the apparatus or device 172. Light leaving the apparatus or cube 1, through the opening 57*a* goes into the first end of tube 200, travels through the tube 200, and into the opening of apparatus or device 180, similar, identical to or analogous to opening 160*a* of the device 172.

The opening 57*b* in apparatus or cube 1 is connected to a first end of tube 206. A second end of tube 206, which opposes the first end of tube 206, is connected to an opening of apparatus or device 186, similar, identical or analogous to opening 160*a* of the apparatus or device 172. Light leaving the apparatus or cube 1, through the opening 57*b* goes into the first end of tube 206, travels through the tube 206, and into the opening of apparatus or device 186, similar, identical to or analogous to opening 160*a* of the device 172.

The eight openings 61*a-d*, 53*a-b*, and 57*a-b* are used in FIG. 10, because they are near the top of cube or apparatus 1, which allows light to come down into the devices 172, 174, 176, 178, 180, 182, 184, and 186. The sixteen openings 63*a-d*, 59*a-d*, 53*c-d*, 57*c-d*, and 55*a-d* shown in FIG. 3A, may not be used and thus may be closed to prevent any light from coming through openings 63*a-d*, 59*a-d*, 53*c-d*, 57*c-d*, and 55*a-d*. Thus of the twenty-four light openings of cube or apparatus 1, only eight openings at the top corners 61*a-d*, 53*a-b*, 57*a-b* are used, and the rest of the openings, such as 63*a-d*, 59*a-d*, 53*c-d*, 57*c-d*, and 55*a-d* are closed in at least one embodiment.

Figure 11:
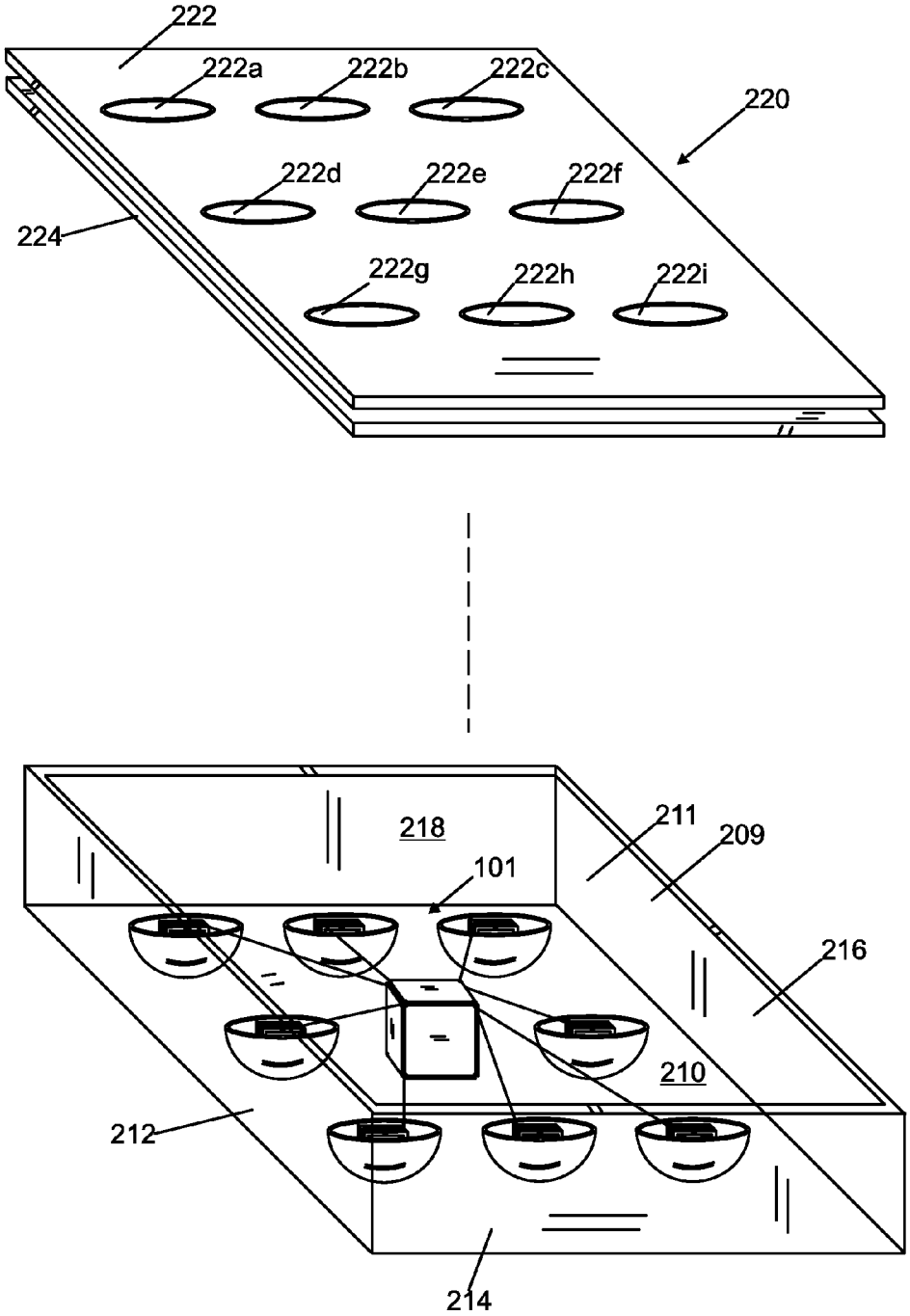
FIG. 11 shows a perspective view of a light emitting diode cover device, and an open box structure, with the plate of FIG. 10 being the bottom of the open box structure, and with the open box structure shown in transparent form, and shown not connected to the light emitting diode cover device.

FIG. 11 shows a top, left, and front perspective view of a light emitting diode cover device 220, and an open box structure 209, with the plate 210 of FIG. 10 being the bottom of the open box structure 209, and with the open box structure 209 shown in transparent form, and shown not connected to the light emitting diode cover device 220. FIG. 11 includes the apparatus 101 shown in FIG. 10.

Figure 15A:
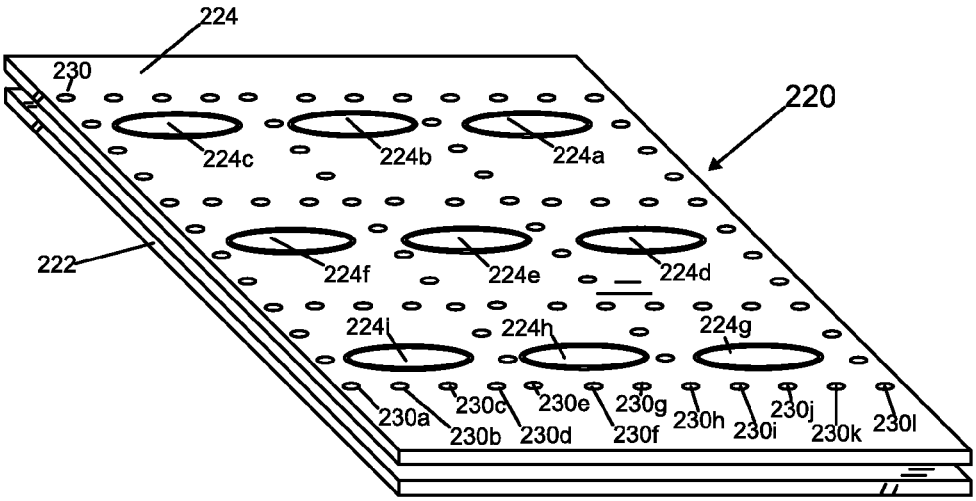
FIG. 15A shows a bottom, rear, and right perspective view of the light emitting diode cover device, without the balls of FIG. 14.

The light emitting diode cover device 220 includes a board 222 and a board 224. The board 222 has circular openings 222*a*, 222*b*, 222*c*, 222*d*, 222*e*, 222*f*, 222*g*, 222*h*, and 222*i* as shown in FIG. 11. The board 224 has circular openings 224*a*, 224*b*, 224*c*, 224*d*, 224*e*, 224*f*, 224*g*, 224*h*, and 224*i* as shown in FIG. 15A, which align with the openings 222*a*-222*i*.

Figure 12:
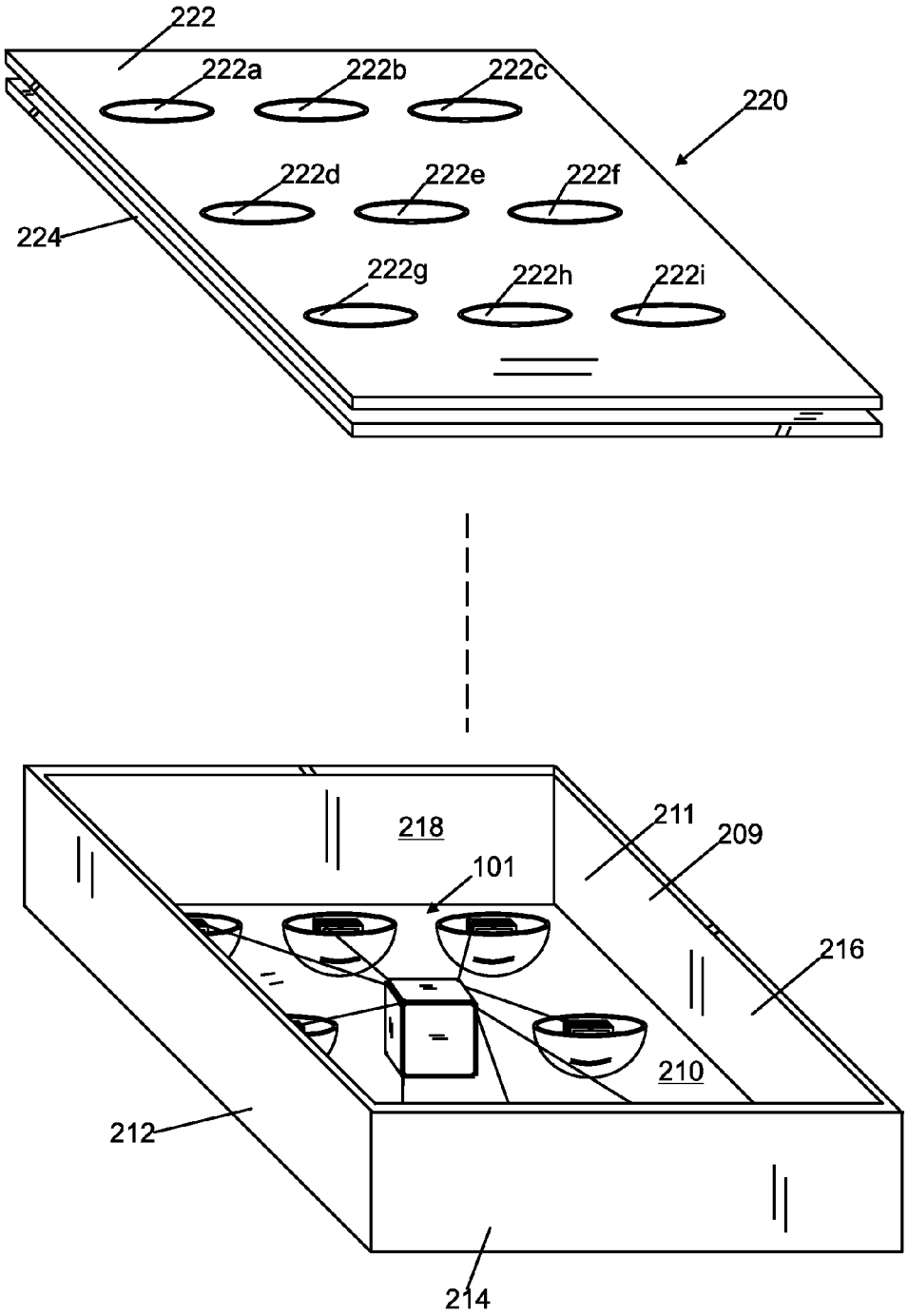
FIG. 12 shows a perspective view of the light emitting diode cover device, and the open box structure of FIG. 11, with the plate of FIG. 10 being the bottom of the open box structure, and with the open box structure not shown in transparent form, and shown not connected to the light emitting diode cover device.

FIG. 12 shows a perspective view of the light emitting diode cover device 220, and the open box structure 209 of FIG. 11, with the plate 210 of FIG. 10 being the bottom of the open box structure 209, and with the open box structure 209 not shown in transparent form, and shown not connected to the light emitting diode cover device 220.

Figure 13:
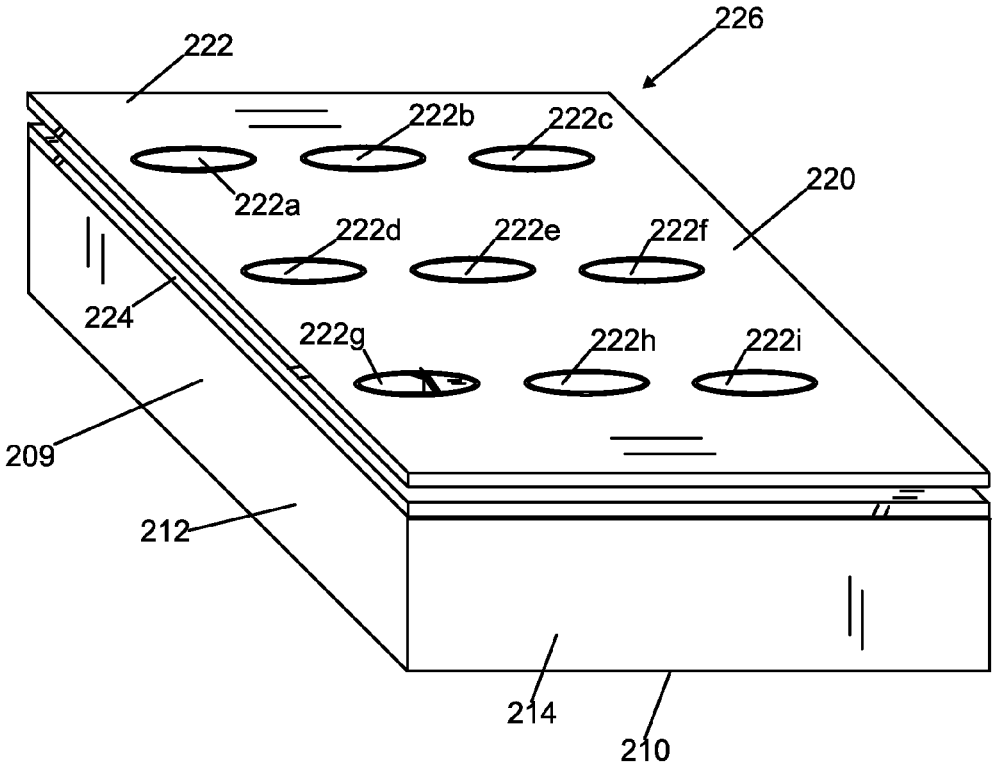
FIG. 13 shows a perspective of the light emitting diode cover device, and the open box structure of FIG. 11, with the plate of FIG. 10 being the bottom of the open box structure, and with the open box structure not shown in transparent form, and with the light emitting diode cover device connected to the open box structure.

FIG. 13 shows a perspective of the light emitting diode cover device 220, and the open box structure 209 of FIG. 11, with the plate 210 of FIG. 10 being the bottom of the open box structure 209, and with the open box structure 209 not shown in transparent form, and with the light emitting diode cover device 220 connected to the open box structure 209 to form an apparatus or device 226. In FIG. 13, the openings 222*a-i* are aligned over and with the circular rims of the bowls 102, 104, 106, 108, 110, 112, 114, and 116, respectively. Light from sunlight and/or ultraviolet light comes through crystal or transparent balls 228*a*-1, and then is reflected by inside surfaces of bowls 102-116 (such as inside surface 102*a* of bowl 102 and analogous surfaces of bowls 104-116). Light reflected inside bowls 102, 104, 106, 108, 110, 112, 114, and 116 (such as inside off of inside surface 102*a* of bowl 102 and off of analogous inside surfaces of bowls 104, 106, 108, 110, 112, 114, and 116) causes an optimal photovoltaic effect on the respective six outside faces (of plates 120, 122, 124, 126, 128, and 130 for apparatus 172 for bowl 102; and analogous outside faces of analogous plates of apparatuses 174, 176, 178, 180, 182, 184, and 186 shown in FIG. 10 for bowls 104, 106, 108, 110, 112, 114, and 116, respectively). This causes energy to be generated by each of the plates 120, 122, 124, 126, 128, and 130 for bowl 102 and analogous plates for bowls 104-116. The plates 120-130 for bowl 102 and analogous plates for bowls 104-116 may be electrically connected by wires so that they can be used as a power source, in the manner that solar panels or solar cells in general are used as power sources. The inner surfaces of plates 120-130, such as inner surface 121*b* of plate 120 shown in FIG. 7A, and analogous inner surfaces of plates 122-130 have photovoltaic cells which generate electricity through the photovoltaic effect. The area or space near the joints of six plates 120-130 can be used for wiring to connect six plates 120-130 or their inner or outer surface photovoltaic cells. An opening can be made in any corner of apparatus 172 shown in FIG. 8, an analogous openings in any corner of apparatuses 174-186 for wire transmission of power from plates 120-130 and from analogous plates for apparatuses 174-186.

Figure 14:
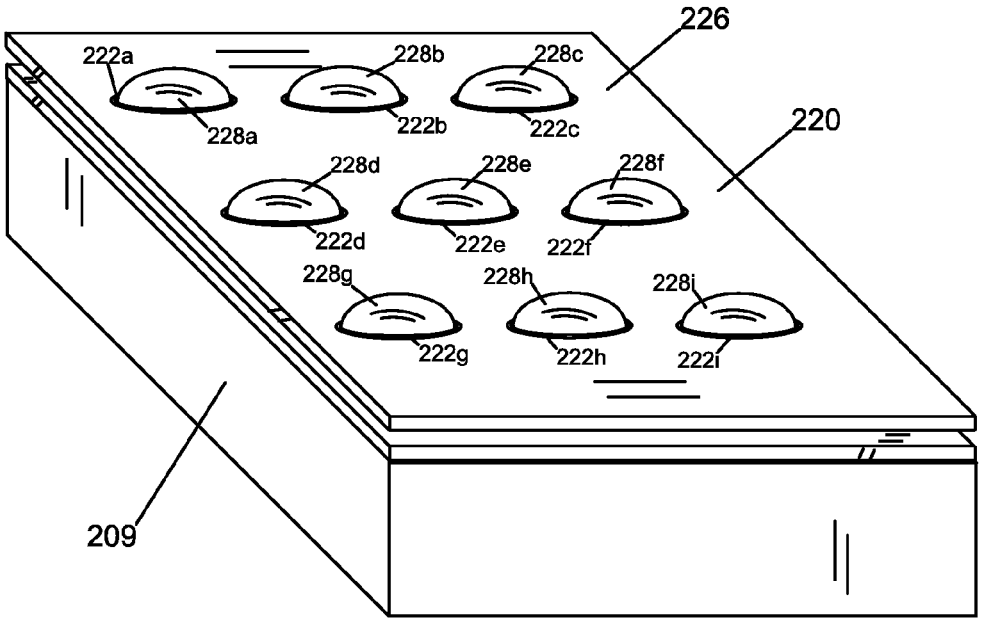
FIG. 14 shows a perspective view of the light emitting diode cover device connected to the open box structure, and with a plurality of balls inserted into openings of the light emitting diode cover device.

FIG. 14 shows a perspective view of the apparatus 226, with the light emitting diode cover device 220 connected to the open box structure 209, and along with a plurality of balls 228*a-i* inserted into openings 222*a-i*, respectively, of the light emitting diode cover device 220. Each of the balls 228*a-i* may be clear crystal balls to provide openings for sunlight and ultraviolet light to go through each of balls 228-*l* into the combination 226 through the cover device 220. The balls 228*a-i* are tightly sealed within openings 222*a-i* so that water does not get into the open box structure 209, where the bowls 102-166 are located.

Figure 15B:
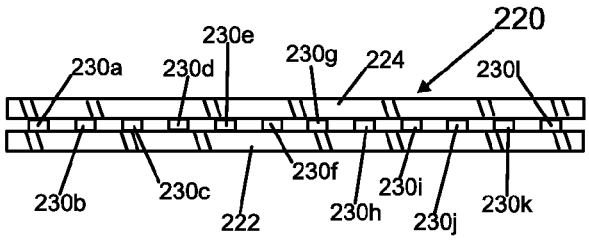
FIG. 15B shows a front view of the light emitting diode cover device, without the balls of FIG. 14.

FIG. 15A shows a bottom, rear, and right perspective view of the light emitting diode cover device 220, without the balls 228*a-i* of FIG. 14. The light emitting diode cover device includes a plurality of LEDs 230, including LEDs 230*a*, 230*b*, 230*c*, 230*d*, 230*e*, 230*f*, 230*g*, 230*h*, 230*i*, 230*j*, 230*k*, and 2301, as shown in FIGS. 15A-15B. FIG. 15B shows a front view of the light emitting diode cover device 220, without the balls 228*a-i* of FIG. 14. Light from LEDs 230, which may be ultraviolet light LEDs, shown in FIG. 15A and FIG. 15B, which first passes through the space between board 222 and board 224 shown in FIG. 15B, and then passes through the crystal balls 228*a-i* to cause photovoltaic effect on the outside faces of plates, such as plates 120, 122, 124, 126, 128, and 130 for apparatus 172 and analogous plates for apparatuses 174-186.

The crystal balls 228*a-i* collect and focus sunlight, coming from outside the closed box 226 shown in FIG. 14, and ultraviolet light from LEDs 230 mounted on board 222 and board 224 as shown in FIGS. 15A-15B, into the box 226 onto the eight photovoltaic cubes or apparatus 172-186, by use of bowls 102-116 to cause photovoltaic effect on outer surface photovoltaic cells of plates 120-130.

Figure 16A:
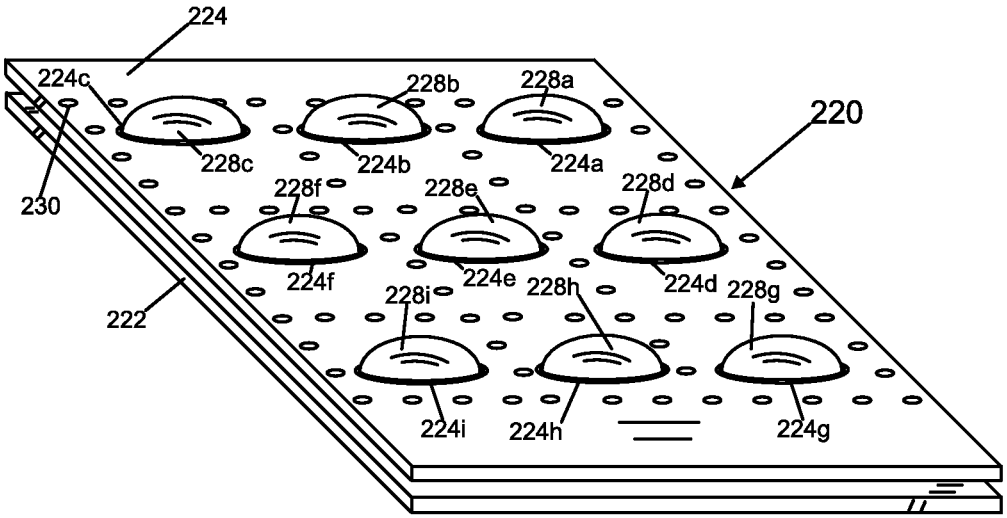
FIG. 16A shows a bottom, rear, and right perspective view of the light emitting diode cover device, with the balls of FIG. 14.
Figure 16B:
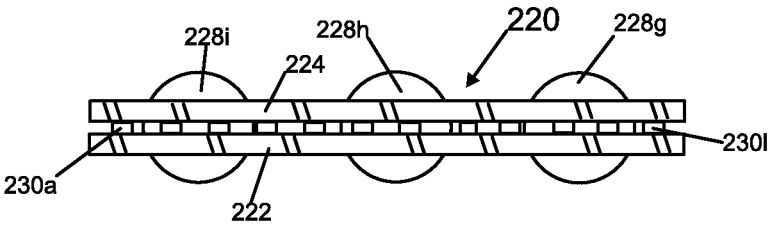
FIG. 16B shows a front view of the light emitting diode cover device, with the balls of FIG. 14.

FIG. 16A shows a bottom, rear, and right perspective view of the light emitting diode cover device 220, with the balls 228*a-i* of FIG. 14 inserted into the openings 224*a-i*. FIG. 16B shows a front view of the light emitting diode cover device 220, with the balls 228*a-i* of FIG. 14.

The LEDs 58*a-c*, shown in FIG. 3A, for light emitting diode device 58, may include a red LED for 58*a*, a green LED for LED 58*b*, and a blue LED for LED 58*c*. Similarly, the LEDs 58*d-f* may include a red LED for 58*d*, a green LED for LED 58*e*, and a blue LED for LED 58*f*. Similarly, the LEDs 58*g-i* may include a red LED for 58*g*, a green LED for LED 58*h*, and a blue LED for LED 58*i*.

Each of the light emitting diode devices 52, 54, 56, 60, and 62 may include nine LEDs of identical colors and/or types as the LEDs for light emitting diode device 58.

One or more LEDs of the light emitting diode device 58 may be activated by a signal from the control circuit 302, which may include a numeral from 0-9, in accordance with the following Table A.

TABLE A

| Color for LED set 58a-c | Color for LED set 58d-f | Color for LED set 58g-i | Numeral |
|---|---|---|---|
| Red (LED 58a on, LEDs 58b-c off) | Green (LED 58d, 58f off, LED 58e on) | Blue (LED 58g-h off, LED 58i on) | 0 |

TABLE A-continued

| Color for LED set 58a-c | Color for LED set 58d-f | Color for LED set 58g-i | Numeral |
|---|---|---|---|
| Red (LED 58a on, LEDs 58b-c off) | Red (LED 58d on, LED 58e-f off) | Red (LED 58g on, LED 58h-i off) | 1 |
| Green (LED 58a, 58c off, LED 58b on) | Green (LED 58d, 58f off, LED 58e on) | Green (LED 58g, 58i off, LED 58h on) | 2 |
| Blue (LED 58a-b off, LED 58c on) | Blue (LED 58d-e off, LED 58f on) | Blue (LED 58g-h off, LED 58i on) | 3 |
| Red (LED 58a on, LEDs 58b-c off) | Red (LED 58d on, LED 58e-f off) | Green (LED 58g, 58i off, LED 58h on) | 4 |
| Red (LED 58a on, LEDs 58b-c off) | Red (LED 58d on, LED 58e-f off) | Blue (LED 58g-h off, LED 58i on) | 5 |
| Green (LED 58a, 58c off, LED 58b on) | Green (LED 58d, 58f off, LED 58e on) | Blue (LED 58g-h off, LED 58i on) | 6 |
| Green (LED 58a, 58c off, LED 58b on) | Green (LED 58d, 58f off, LED 58e on) | Red (LED 58g on, LED 58h-i off) | 7 |
| Blue (LED 58a-b off, LED 58c on) | Blue (LED 58d-e off, LED 58f on) | Red (LED 58g on, LED 58h-i off) | 8 |
| Blue (LED 58a-b off, LED 58c on) | Blue (LED 58d-e off, LED 58f on) | Green (LED 58g, 58i off, LED 58h on) | 9 |

The light emitting diodes (LEDs) of the light emitting diode devices 52, 54, 56, 60, and 62 may be turned on or off in a similar, analogous, or identical manner to that of the light emitting diode device 58.

In at least one embodiment, the LEDs of the six light emitting diode devices 52, 54, 56, 58, 60, and 62 may receive codes or control signals, from the controller 302, containing numbers or numerals in a sequence. For example, referring to FIG. 3A and FIG. 17, the controller 302 may provide numerals in control signals in sequence to the LEDs of the upper side or device 60, then the LEDs of the lower part or device 62, then the LEDs of the left part or device 52, then the LEDs of the right part or device 56, then the LEDs of the front part or device 54, and then the LEDs of the rear part or device 58. For example, a sequence of 012345 which cause the upper part or device 60 to emit red, green, blue; the lower part or device 62 to emit red, red, red; the left part or device 52 to emit green, green, green; the right part or device 56 to emit blue, blue, blue; the front part or device 54 to emit red, red, green; and then the rear part or side 58 to emit red, red, blue.

The inner surfaces of the four reflector panels 14*a-d* of the funnel 14 focus or reflect light from the LEDs of device 54 (similar or analogous to LEDs 58*a*-1, but not shown in FIG. 3A (whichever LEDs are active or on), into the crystal ball 6 in the center of the apparatus or cube 1, shown in FIG. 3B. Similarly or identically, the four reflector panels of each of the funnels 12, 16, 18, 20, and 22 focus or reflect light from the LEDs of devices 52, 56, 58, 60, and 62 whichever are active or on, into the crystal ball 6 in the center of the apparatus or cube 1, shown in FIG. 3B.

In accordance with an embodiment of the present invention, a numeric order such as 012345, as previously specified, for activating the LEDs of the devices 60, 62, 52, 56, 54, and then 58 can turn on coded color lights on the six sides in sequence. All the coded color lights from the six sides or devices 60, 62, 52, 56, 54, and 58, in sequence, concentrate into the core crystal ball 6, for mixing up and producing an unique light character of color, wave, and brightness, through optical tubes, such as tubes 34*a-d* shown in FIG. 2C for funnel 14, and similar, identical, or analogous optical tubes for the other funnels 12, 16, 18, 20, and 22

In another embodiment of the present invention, the light character producer can be converted into an ultraviolet beam producer by replacing typical LEDs, such as 58*a-i* and other LEDs of devices 52, 56, 58, 60, and 62, with ultraviolet LED lamps.

A generator of electricity, can be made in at least one embodiment, with the ultraviolet beam producer, device or apparatus 1 shown in FIG. 11, in the center of the open box structure 209, and then covered by the device 220. In the embodiment of FIG. 11, the apparatus 1 may have ultraviolet LED lamps for each of LEDs of the devices 52, 54, 56, 58, 60, and 62.

The photovoltaic cube or apparatus 150, shown in FIG. 7B, is made of six bifacial cells or plates 120, 122, 124, 126, 128, and 130, with a crystal ball 140 inside the apparatus 150 to reflect a light beam received through opening 124*a* evenly and expansively onto the inside surfaces of bifacial cells 120, 122, 124, 126, 128, and 130. The bifacial cells 120-130 may be bifacial photovoltaic solar energy cells. The cube or apparatus 150 is held together and/or supported by frame structure 160 and set on the reflector bowl 102, as shown in FIG. 9, to have optimal light concentration into the outside surfaces of bifacial cells 120, 122, 124, 126, 128, and 130.

In at least one embodiment, eight photovoltaic beams are emitted from eight corners of the ultraviolet beam producer or apparatus 1 and directed through optical fibers or tubes 192, 194, 196, 198, 200, 202, 204, and 206 into eight photovoltaic cubes, identical to cube or apparatus 150 from a corner of apparatus 1, shown in FIG. 10, to a corner of a cube of appropriate cube of devices 172, 174, 176, 178, 180, 182, 184, and 186, as shown in FIG. 10, to have optimal light beam concentration in production and easier accesses into cubes of devices 172-186.

In at least one embodiment, the box cover or device 220 includes an outer circuit board 222 and an inner circuit board 224 as shown in FIG. 11. In between the circuit boards 222 and 224 are a plurality of light emitting diodes 230, such as including light emitting diodes 230*a-l* shown in FIGS. 15A-15B. The light emitting diodes 230*a-l* may be mounted to both the circuit boards 222 and 224. Each of the circuit boards 222 and 224 may have nine large circular openings, 222*a-i*, and 224*a-i*, shown in FIG. 13 and FIG. 15A, respectively.

Each of the circuit boards 222 and 224 may be made substantially or entirely of plastic. The LEDs 230 may be electrically connected by wires not shown, or wirelessly to control circuit 302 shown in FIG. 17, and/or to the battery 318.

The crystal balls 228*a-i* are positioned so that a part of each ball protrudes out from the circuit board 222 and out from the closed box 226 as shown in FIG. 14, and a part of each ball 228*a-i* protrudes into the closed box 226 as shown by FIG. 16B; and this is done to have optimal sunlight exposure outside and expansion inside of the closed box 226.

The optimal electricity generated by the closed box apparatus 226 and the balls 228*a-i* shown in FIG. 14, is the sum of (a) electricity generated due to light from sun received through balls 228*a*-1, into inside of closed box apparatus 226, and reflected off of bowls 102-116, into plates or bifacial cells 120-130 for bowl 102 and analogous plates for bowls 102-116; (b) ultraviolet light received due to LEDs 230 which goes through balls 228*a-i* to cause the same effect as described; the balls 228*a-i* are inserted in such a manner that the middle portion of each of balls 228*a-i* is between the circuit boards 222 and 224 to be firmly fixed and receive light from LEDs 230 across space between two boards 222 and 224; and (c) light received due to apparatus or cube 1 of FIG. 3B used as an ultraviolet light producer, to cause photovoltaic effect on inner faces of plates 120-130 (such as inner face 121*b*, and analogous faces or cells of plates 122-130).

The light emitting diodes 230 shown in FIG. 15A can be electrically connected to a and powered by a rechargeable battery, such as battery 318, which may be placed somewhere inside of the closed box apparatus 226 and in this manner the apparatus 226 can generate electricity with or without sunlight, from the photovoltaic devices or bowl and device combinations 102 and 172, 104 and 174, 106 and 176, 108 and 178, 110 and 180, 112 and 182, 114 and 184, and 116 and 186.

Where the cube device 1 is used as a light character producer, the mixed light provided through an optical tube or fiber, such as tube 40*a* shown in FIG. 2C exits at corner 61*a* of the apparatus 1 of FIG. 3B. The number, 012345, in one example, in numeric order, produces a unique light from the crystal ball 6 representing meaning or an object such as a security code, communication, or product identification.

In one example, 012345 is a combined numeric order, one of the million combinations of six digits. Each side or device of devices 52, 54, 56, 58, 60, and 62 of the cube device 1 as a light character producer can take a numeric order, ranging from 0 to 9, that is ten options. Six sides or devices 52, 54, 56, 58, 60, and 62 together have total combinations of options: 10×10×10×10×10×10, one million combined numeric orders to produce one million light.

Figure 18:
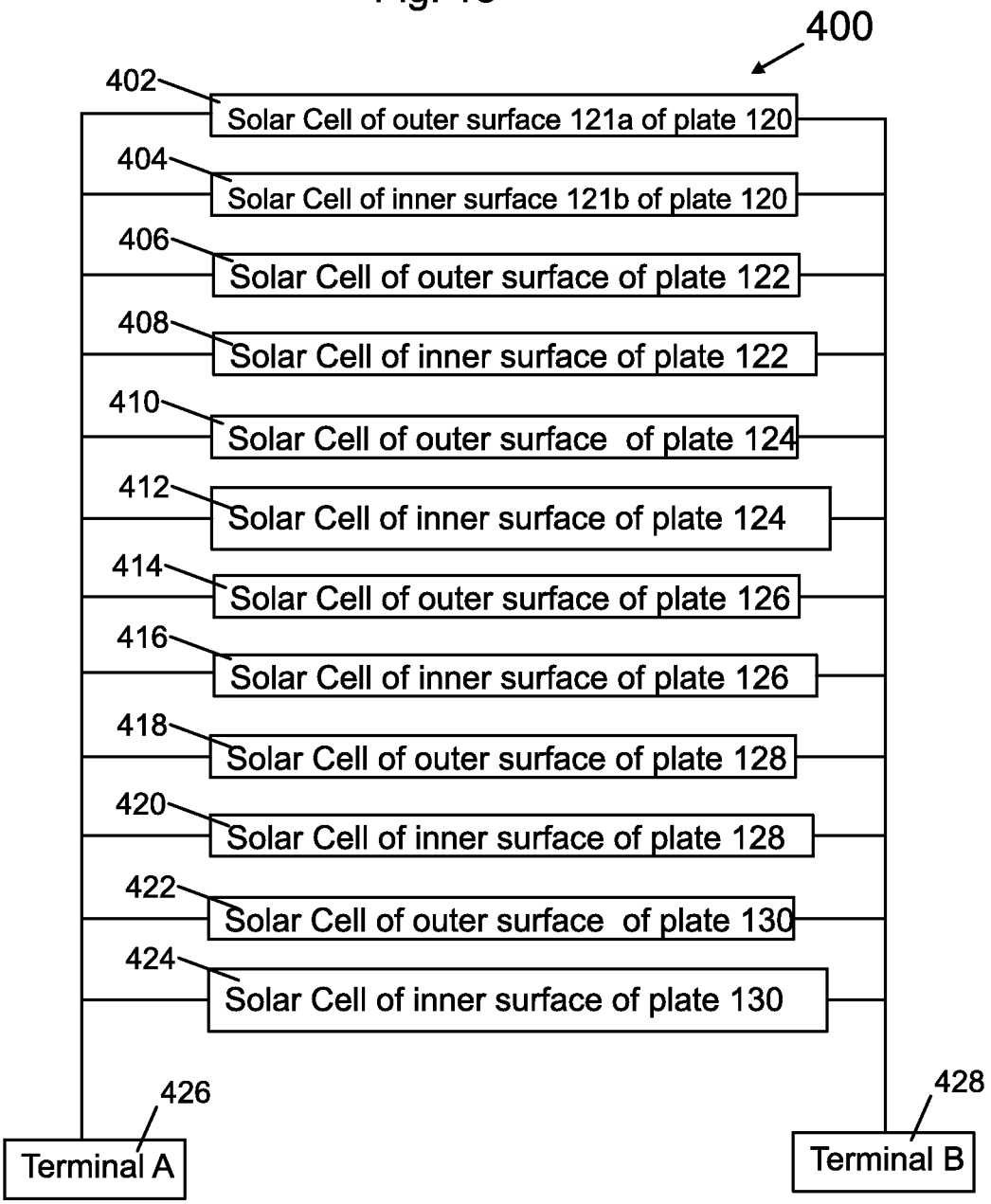
FIG. 18 shows a block diagram of solar cells of plates of FIG. 7A connected to terminals for use as power sources.

FIG. 18 shows a block diagram 400 of solar cells of plates 120, 122, 124, 126, 128, and 130 of FIG. 7A connected to terminals 426 and 428 for use as power sources. In at least one embodiment of the present application, one or more solar cells of plates 120-130 can be used as power sources to power for example, home appliances, lighting, or any other electrical device through terminals such as terminals 426 and 428. Although shown in parallel, the solar cells of plates 120-130 may be connected in series or in a combination of series and parallel. FIG. 18 shows blocks 402, 404, 406, 408, 410, 412, 414, 416, 418, 420, and 424 which represent solar cells of the specified surface of the specified plate.

In general operation, one or more embodiments of the present application have three functions:

(A) Outer solar cells of plates 120-130 for bowl 102 and analogous outer solar cells for plates of bowls 104-116 generate electricity from sunlight and/or other light which comes into closed box structure 226 of FIG. 14, through balls 228*a-i*, through openings 222*a-i*, into bowls 102-116 shown in FIG. 10, which is directed into outer solar cells of plates 120-130 for bowl 102, shown in FIG. 7A, and analogous outer solar cells for bowls 104, 106, 108, 110, 112, 114, and 116.

(B) Inner solar cells of plates 120-130 for bowl 102 and analogous inner solar cells of plates of bowls 104-116 generate electricity from light coming from tubes 192, 194, 196, 198, 200, 202, 204, and 206, shown in FIG. 10, originating from fifty-four LEDs (nine LEDs from each of devices 52, 54, 56, 58, 60, and 62 of FIG. 3A) of devices 52-62, which may be powered by battery 318 shown in FIG. 17.

(C) Additionally, outer solar cells of plates 120-130 for bowl 102 and analogous outer solar cells for plates of bowls 104-116 generate electricity from LEDs 230, shown in FIG. 15A directed towards bowls 102-116, in the same direction as sunlight, i.e. directions D2-D4 shown in FIG. 9A. The LEDs 230 may be powered by battery 318 shown in FIG. 17.

In addition to the above functions, sunlight and/or other light which comes into closed box structure 226 of FIG. 14, through balls 228*a-i*, through openings 222*a-i*, into bowls 102-116 shown in FIG. 10, which is directed into outer solar cells of plates 120-130 for bowl 102, shown in FIG. 7A, and analogous outer solar cells for bowls 104, 106, 108, 110, 112, 114, and 116, may also be used to recharge a rechargeable battery, which may be electrically connected to terminal A 426 and terminal B 428 shown in FIG. 18, which can be used for power for sunlight is not available.

In addition, the apparatus 1 shown in FIG. 3B can be used by itself as a light character producer, for example in accordance with Table A as previously described, wherein various combinations of on and/or off LEDs of devices 52-62 are sensed, processed, and interpreted as a number, such as from 0 to 9, or an alphabetic character such as from A through Z. For example, the number "0" may be represented by the combination of red LED 58*a* on, green LED 58*b*, and blue LED 58*c* off, red LED 58*d* and blue LED 58*f* off, and green LED 58*e* on, and red LED 58*g*, green LED 58*h* off, and blue LED 58*i* on, as shown in Table A above. The light from the on LEDs, in this example, red 58*a*, green 58*e*, and blue 58*i*, is reflected off of the interior walls of rear funnel 18, and goes into transparent and/or crystal ball 6 shown in FIG. 3A. The light from red 58*a*, green 58*e*, and blue 58*i* mixes in ball 6 and comes out of all of tubes of funnels 12, 14, 16, 18, 20, and 22, such as tubes 34*a*-*d* of funnel 14 shown in FIG. 2C and analogous tubes of funnels 12, 16, 18, 20, and 22. So a red, green and blue mixed light projects out from all of twenty-four tubes, and from all eight vertices of the apparatus or cube 1 (i.e. there are three tubes per vertex of the cube 1). This mixture of red, green, and blue light, which may mix to become white light, may be sensed at the output of any of the twenty-four tubes or all of them, by for example by a color light sensor, which may provide a specific electrical output or digital signal for a specific color light. For example, the light sensor may provide a digital "001" signal for sensed white light, "011" for sensed red light, and other different digital signals for other color lights. In this manner the apparatus 1 may be used to generate a character.

In addition, the apparatus 1 may be used at the center of box 226 as shown in FIGS. 10-12 as an ultraviolet light producer.

In another embodiment, the box 226 of FIG. 14 may be covered by something to prevent light from going out through balls 228*a*-*i*, when sunlight is not available, and a rechargeable battery, such as connected through terminal A 426 and terminal B 428 shown in FIG. 17, and/or represented by battery 318 in FIG. 17 is used to power LEDs 230.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first funnel having an inner surface;

a transparent solid spherical ball;

a first tube having a first end and a second end;

a first light emitting diode device having an inner surface with a first light emitting diode;

wherein the first end of the first tube is closer to the transparent solid spherical ball than the second end of the first tube; and wherein the first funnel, the transparent solid spherical ball, the first tube, and the first light emitting diode device are configured with respect to each other so that light from the first light emitting diode of the first light emitting diode device is reflected off of the inner surface of the first funnel into the transparent solid spherical ball, and then from the transparent solid spherical ball into the first end of the first tube, then through the first tube, and then out from the second end of the first tube; and further comprising second, third, fourth, fifth, and sixth funnels, each substantially the same as the first funnel, and each having an inner surface;

second, third, fourth, fifth, and sixth light emitting diode devices, each having a first light emitting diode;

wherein the first through sixth funnels, the transparent solid sphere, the first tube, and the first through sixth light emitting diode devices are configured with respect to each other so that light from the first light emitting diodes of the first through sixth light emitting diode devices is reflected off of the inner surfaces of the first through sixth funnels into the transparent solid sphere spherical ball, and then from the transparent solid sphere spherical ball into the first end of the first tube, then through the first tube, and then out from the second end of the first tube.

2. The apparatus of claim 1 wherein the first light emitting diode device includes a second light emitting diode and a third light emitting diode;

wherein the first light emitting diode of the first light emitting diode device emits red colored light when it is on, the second light emitting diode of the first light emitting diode device emits green colored light when it is on, and the third light emitting diode of the first light emitting diode device emits blue colored light when it is on; and wherein the first funnel, the transparent solid sphere, the first tube, and the first light emitting diode device are configured with respect to each other so that light from the first through the third light emitting diodes of the first light emitting diode device is reflected off of the inner surface of the first funnel into the transparent solid spherical ball, and then from the transparent solid spherical ball into the first end of the first tube, then through the first tube, and then out from the second end of the first tube.

3. The apparatus of claim 2 wherein the transparent solid spherical ball is a crystal ball.

4. The apparatus of claim 1 wherein each of the first through sixth light emitting diode devices includes a second light emitting diode and a third light emitting diode;

wherein the first light emitting diode of each of the first through sixth light emitting diode devices emits red colored light when it is on, the second light emitting diode of each of the first through sixth light emitting diode device emits green colored light when it is on, and the third light emitting diode of each of the first through sixth light emitting diode devices emits blue colored light when it is on; and wherein the first through sixth funnels, the transparent solid spherical ball, the first tube, and the first through sixth light emitting diode devices are configured with respect to each other so that light from each of the first through the third light emitting diodes of each of the first through sixth light emitting diode devices is reflected off of the inner surface of the first through sixth funnels, respectively, into the transparent solid spherical ball, and then from the transparent solid spherical ball into the first end of the first tube, then through the first tube, and then out from the second end of the first tube.

5. The apparatus of claim 4 wherein the transparent solid spherical ball is a crystal ball.

6. The apparatus of claim 1 wherein the transparent solid spherical ball is a crystal ball.

* * * * *